US012532942B2

(12) United States Patent
Tsukada et al.

(10) Patent No.: US 12,532,942 B2
(45) Date of Patent: Jan. 27, 2026

(54) SOLE AND SHOE

(71) Applicant: ASICS CORPORATION, Kobe (JP)

(72) Inventors: Hiroyuki Tsukada, Kobe (JP); Hiroki Miyake, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 18/699,050

(22) PCT Filed: Oct. 5, 2021

(86) PCT No.: PCT/JP2021/036848
§ 371 (c)(1),
(2) Date: Apr. 5, 2024

(87) PCT Pub. No.: WO2023/058119
PCT Pub. Date: Apr. 13, 2023

(65) Prior Publication Data
US 2024/0407499 A1 Dec. 12, 2024

(51) Int. Cl.
*A43B 13/18* (2006.01)

(52) U.S. Cl.
CPC ..... *A43B 13/186* (2013.01)

(58) Field of Classification Search
CPC ..... A43B 13/125; A43B 13/14; A43B 13/18; A43B 13/181; A43B 13/183; A43B 13/186
See application file for complete search history.

(56) References Cited

U.S. PATENT DOCUMENTS 5,233,767 A * 8/1993 Kramer ..... A43B 13/206 36/35 B
2003/0106240 A1* 6/2003 Wang ..... A43B 5/08 36/7.5
2010/0071228 A1* 3/2010 Crowley, II ..... A43B 13/181 36/28
2012/0180335 A1* 7/2012 Mahoney ..... A43B 23/027 36/28

(Continued)

FOREIGN PATENT DOCUMENTS

JP 3049755 U 6/1998
JP 2019-063491 A 4/2019

(Continued)

OTHER PUBLICATIONS

International Search Report issued in PCT/JP2021/036848; mailed Dec. 7, 2021.

*Primary Examiner* — Bao-Thieu L Nguyen
(74) *Attorney, Agent, or Firm* — Studebaker Brackett PLLC

(57) ABSTRACT

Provided is a sole constituting a part of a shoe, the sole including: a shock-absorbing part that cushions an impact applied to a foot upon landing; and a support part that is higher in elastic modulus than the shock-absorbing part and supports the foot. The support part includes a support surface provided around the shock-absorbing part. The shock-absorbing part includes a recessed surface and a plurality of columnar bodies. The shock-absorbing part includes a high-elastic region located adjacent to the support surface and a low-elastic region that is located adjacent to the high-elastic region and lower in elastic modulus than the high-elastic region.

11 Claims, 25 Drawing Sheets

(56) References Cited

U.S. PATENT DOCUMENTS

| | | | | |
|---|---|---|---|---|
| 2012/0180336 | A1* | 7/2012 | Sullivan | A43B 13/188 36/31 |
| 2013/0104419 | A1 | 5/2013 | Horesh et al. | |
| 2015/0223560 | A1 | 8/2015 | Wawrousek et al. | |
| 2016/0037860 | A1* | 2/2016 | Holt | A43B 13/186 12/146 B |
| 2016/0235159 | A1* | 8/2016 | Bauerfeind | A43B 17/023 |
| 2017/0340058 | A1* | 11/2017 | Madore | A43B 7/146 |
| 2018/0084864 | A1* | 3/2018 | Takada | A43B 7/1435 |
| 2018/0192736 | A1* | 7/2018 | Luedecke | A43B 23/0255 |
| 2018/0338574 | A1* | 11/2018 | Cross | A43B 13/189 |
| 2019/0090583 | A1 | 3/2019 | Sato et al. | |
| 2020/0093219 | A1* | 3/2020 | Luchi | A43B 13/183 |
| 2020/0305541 | A1 | 10/2020 | Yahata et al. | |
| 2021/0256585 | A1* | 8/2021 | Wang | B29D 35/0009 |
| 2021/0267303 | A1* | 9/2021 | Lilley | A43B 3/10 |
| 2022/0007783 | A1* | 1/2022 | Ardissono | A43B 7/06 |
| 2022/0279894 | A1* | 9/2022 | Lambertz | A43B 13/181 |
| 2022/0312890 | A1* | 10/2022 | Yoshida | A43B 7/144 |
| 2023/0108812 | A1* | 4/2023 | Ozawa | A43B 7/1425 36/28 |
| 2023/0123675 | A1* | 4/2023 | Ozawa | A43B 7/148 36/28 |

FOREIGN PATENT DOCUMENTS

| | | | |
|---|---|---|---|
| JP | 2020-163083 | A | 10/2020 |
| WO | 2021-210044 | A1 | 10/2021 |

* cited by examiner

SOLE AND SHOE

TECHNICAL FIELD

This disclosure relates to a sole and a shoe.

BACKGROUND

Shoes having a structure for cushioning an impact applied to a foot upon landing have been known. For example, US 2015/0223560 A discloses a midsole having a plurality of convex elements. The plurality of convex elements each have a shape extending from a recessed surface provided on a surface of the midsole to the surface of the midsole. The plurality of convex elements are formed all over the midsole.

CITATION LIST

Patent Literature

PTL 1: US 2015/0223560 A

SUMMARY

Technical Problem

For the sole disclosed in US 2015/0223560 A, it is conceivable to lower the elastic modulus of each convex element in order to further improve the shock-absorbing property, for example. This, however, makes a difference in elastic modulus between each convex element and a boundary between the surface of the midsole and the convex element larger, which increases a sense of discomfort felt by the wearer.

It is therefore an object of the present disclosure to provide a sole and a shoe that achieve both cushioning against an impact applied to a foot upon landing and reduction of a sense of discomfort felt by a wearer.

Solution to Problem

A sole according to one aspect of this disclosure is a sole constituting a part of a shoe, the sole including: a shock-absorbing part that cushions an impact applied to a foot upon landing; and a support part that is higher in elastic modulus than the shock-absorbing part and supports the foot, in which the support part includes a support surface provided around the shock-absorbing part, the shock-absorbing part includes: a recessed surface located at a height position lower than the support surface; and a plurality of columnar bodies each having a shape extending from the recessed surface to a height position identical in height to the support surface, and the shock-absorbing part includes: a high-elastic region that is located adjacent to the support surface; and a low-elastic region that is located adjacent to the high-elastic region and lower in elastic modulus than the high-elastic region.

Further, a shoe according to one aspect of this disclosure includes the sole and the upper directly or indirectly connected to the sole and located above the sole.

Advantageous Effects of Invention

According to this disclosure, it is possible to provide the sole and the shoe that achieve both cushioning against an impact applied to a foot upon landing and reduction of a sense of discomfort felt by a wearer.

DETAILED DESCRIPTION

Figure 1:
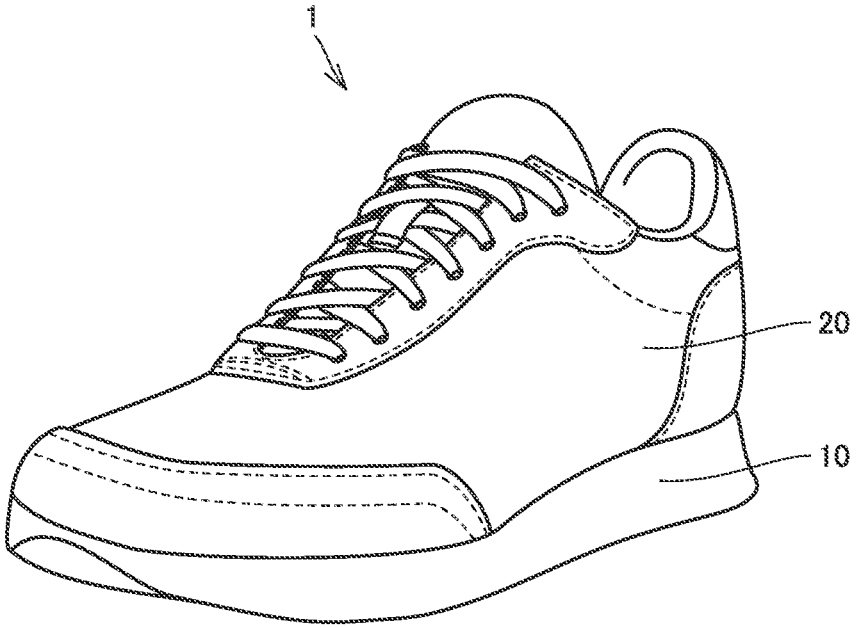
FIG. 1 is a schematic perspective view of a shoe according to a first embodiment of the present disclosure.

Embodiments according to this invention will be described with reference to the drawings. Note that, in the drawings to be referenced below, the same or corresponding members are denoted by the same reference numerals. In the following description, terms such as longitudinal direction, width direction, fore, and rear are used. Such directional terms indicate directions viewed from the viewpoint of a wearer wearing a shoe 1 placed on a flat surface such as the ground. For example, the fore refers to a toe side, and the rear refers to a heel side. Further, a medial side refers to a first toe side of the foot in the width direction, and a lateral side refers to a fifth toe side of the foot in the width direction.

First Embodiment

Figure 2:
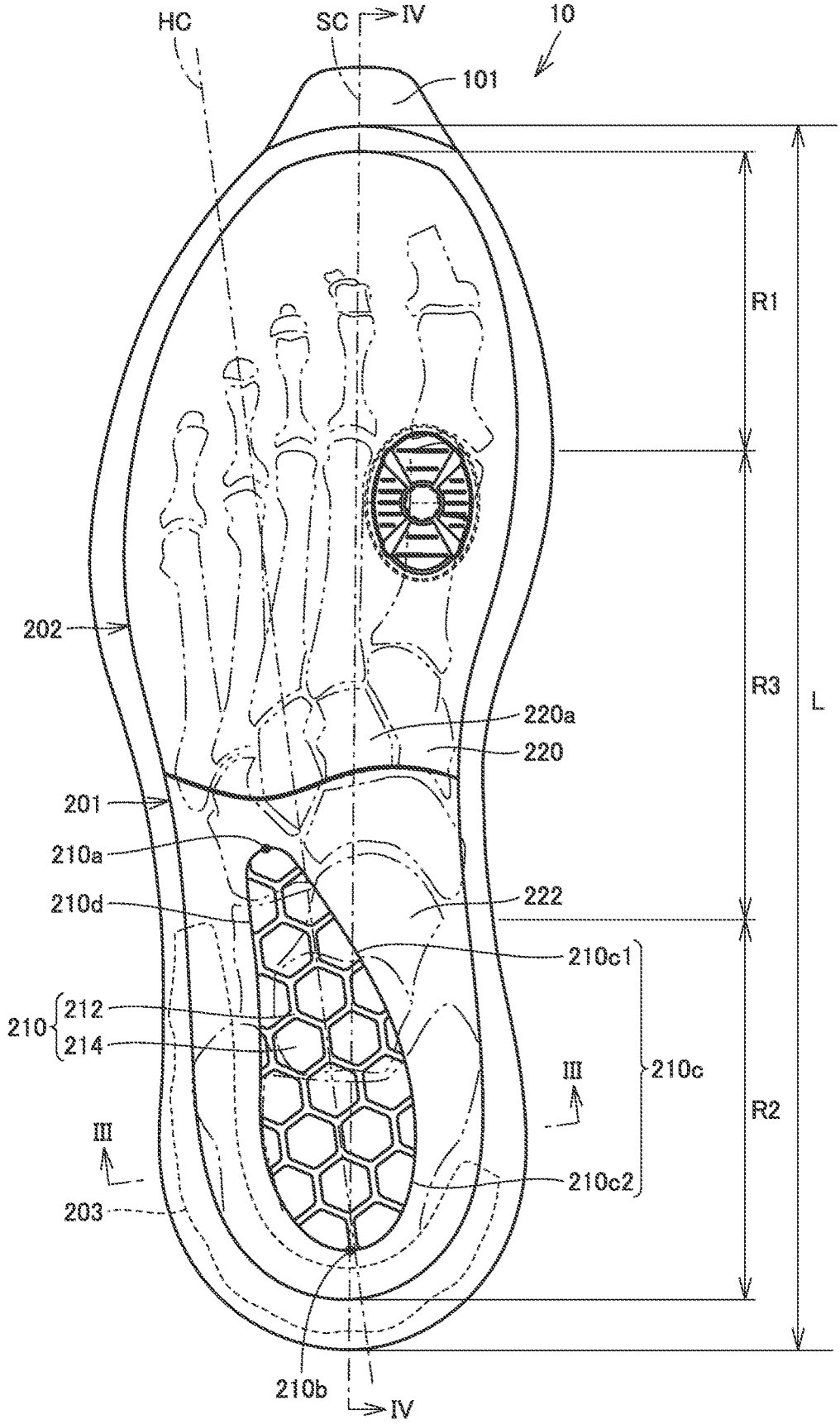
FIG. 2 is a plan view of a sole.
Figure 3:
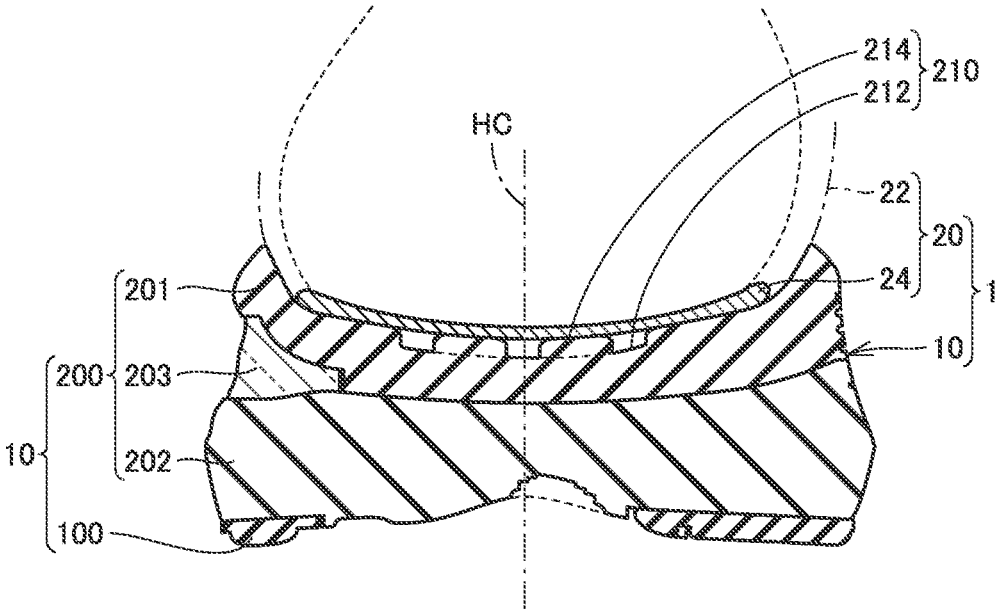
FIG. 3 is a cross-sectional view taken along line III-III in FIG. 2.
Figure 4:
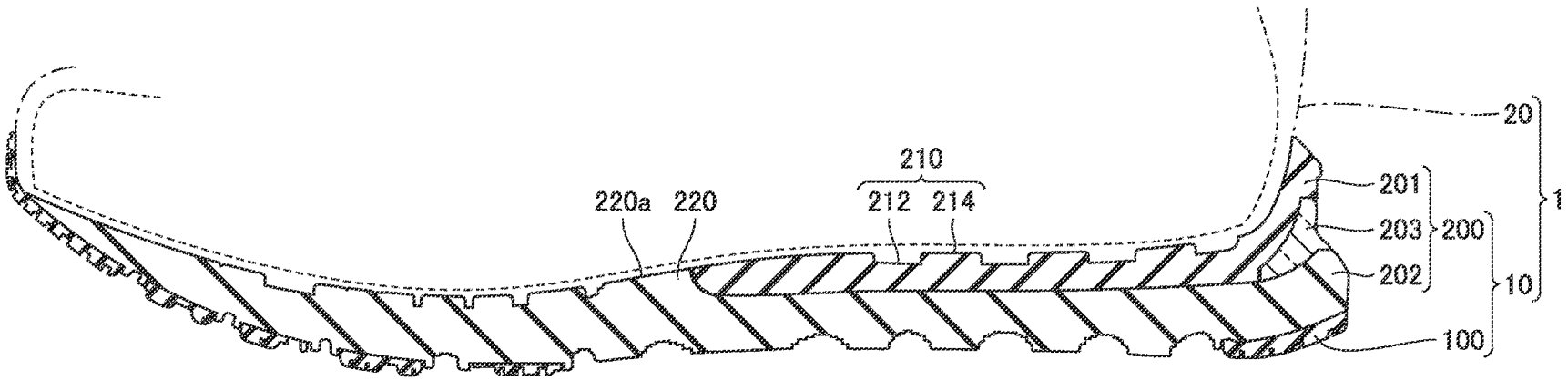
FIG. 4 is a cross-sectional view taken along line IV-IV in FIG. 2.

FIG. 1 is a schematic perspective view of a shoe according to a first embodiment of the present disclosure. FIG. 2 is a plan view of a sole. FIG. 3 is a cross-sectional view taken along line III-III in FIG. 2. FIG. 4 is a cross-sectional view taken along line IV-IV in FIG. 2. Note that FIG. 2 illustrates a sole 10 for the left foot, but this sole 10 is also applicable to the right foot, and in this case, the sole 10 for the right foot and the sole 10 for the left foot are symmetrical. The shoe 1 according to the present embodiment is suitable for running shoes, for example, but is also applicable to other athletic shoes or walking shoes, and there is no limitation on the use of the shoe.

As illustrated in FIGS. 1, 3, and 4, the shoe 1 includes the sole 10 and an upper 20.

The upper 20 is connected to the sole 10 to form a space for accommodating a foot with the sole 10. As illustrated in FIG. 3, the upper 20 includes an upper main body 22 and an insole 24. The upper main body 22 covers an upper surface of the foot. The insole 24 is connected to a lower portion of the upper main body 22 to constitute a bottom portion of the upper 20. The insole 24 is connected to a surface of the sole 10.

The sole 10 constitutes a part of the shoe 1. The sole 10 is connected to a lower portion of the upper 20. The sole 10 includes an outer sole 100 and a midsole 200.

The outer sole 100 constitutes a tread portion. The outer sole 100 is made of rubber or the like.

The midsole 200 is provided on the outer sole 100. The upper 20 is disposed on the midsole 200. That is, the midsole 200 is provided between the upper 20 and the outer sole 100.

The midsole 200 is formed of, for example, a resin foam material containing a resin material as a main component and a foaming agent and a cross-linking agent as accessory components. Preferable examples of the resin material include a resin foam such as a polyolefin resin, a polyurethane resin, a nylon resin, and an ethylene-vinyl acetate copolymer. Alternatively, the midsole 200 may be formed of a rubber foam material containing a rubber material as a main component and a plasticizer, a foaming agent, a reinforcing agent, and a cross-linking agent as accessory components. As the rubber material, for example, a butadiene rubber can be suitably used. Note that the material of the midsole 200 is not limited to the above-described materials, and the midsole 200 may be formed of a resin or rubber material having an appropriate strength and excellent shock-absorbing property.

The midsole 200 includes a forefoot region R1, a rearfoot region R2, and a midfoot region R3. The forefoot region R1 is a region located at a fore portion of the shoe 1 in the longitudinal direction. The rearfoot region R2 is a region located at a rear portion of the shoe 1 in the longitudinal direction. The midfoot region R3 is a region located between the forefoot region R1 and the rearfoot region R2.

The forefoot region R1 is a region extending over a range of about 0% to 30% of an entire length of the shoe 1 from a fore end part to a rear end part of the shoe 1. The midfoot region R3 is a region extending over a range of about 30% to 80% of the entire length of the shoe 1 from the fore end part to the rear end part of shoe 1. The rearfoot region R2 is a region extending over a range of 80% to 100% of the entire length of the shoe 1 from the fore end part to the rear end part of the shoe 1.

As illustrated in FIG. 2, the midsole 200 includes a shock-absorbing part 210 and a support part 220.

The shock-absorbing part 210 is a portion that cushions an impact applied to the heel of the foot upon landing. The shock-absorbing part 210 is provided at least in the rearfoot region R2. In the present embodiment, the shock-absorbing part 210 is provided over a region extending from the rearfoot region R2 to a rear of the midfoot region R3. The shock-absorbing part 210 is preferably formed over a range of 50% or less of the shoe 1 from the rear end part of the shoe 1 along a center line SC (see FIG. 2) of the shoe 1. Note that the center line SC is not limited to the center line of the shoe 1, and may be a line corresponding to a straight line connecting a center of a calcaneus of a typical wearer of the shoe 1, and a gap between the first toe and the second toe.

The shock-absorbing part 210 includes a fore end part 210*a*, a rear end part 210*b*, a medial edge part 210*c*, and a lateral edge part 210*d*.

The fore end part 210*a* is a portion located at a fore end in the longitudinal direction. As illustrated in FIG. 2, the fore end part 210*a* is located on the lateral side relative to the center line SC in the width direction.

The rear end part 210*b* is a portion located at a rear end in the longitudinal direction. As illustrated in FIG. 2, the rear end part 210*b* is located roughly on the center line SC.

The medial edge part 210*c* connects the fore end part 210*a* and the rear end part 210*b*, and constitutes a medial edge of the shock-absorbing part 210 in the width direction. The medial edge part 210*c* includes a fore edge part 210*c*1 and a rear edge part 210*c*2.

The fore edge part 210*c*1 constitutes a fore portion of the medial edge part 210*c* in the longitudinal direction. The fore edge part 210*c*1 has a shape gradually extending toward the medial side in the width direction while extending from the fore end part 210*a* toward the rear end part 210*b*. In the present embodiment, the fore edge part 210*c*1 has a shape curved toward the medial side in the width direction. Note that the fore edge part 210*c*1 may have a shape curved toward the lateral side in the width direction, or may be formed in a linear shape.

The rear edge part 210*c*2 constitutes a rear portion of the medial edge part 210*c* in the longitudinal direction. The rear edge part 210*c*2 has a shape gradually extending toward the lateral side in the width direction while extending toward the rear end part 210*b*. In the present embodiment, the rear edge part 210*c*2 has a shape curved toward the medial side in the width direction. Note that the rear edge part 210*c*2 may have a shape curved toward the lateral side in the width direction, or may be formed in a linear shape.

The lateral edge part 210*d* connects the fore end part 210*a* and the rear end part 210*b*, and constitutes a lateral edge of the shock-absorbing part 210 in the width direction.

The shock-absorbing part 210 includes a recessed surface 212 and a plurality of columnar bodies 214.

Figure 6:
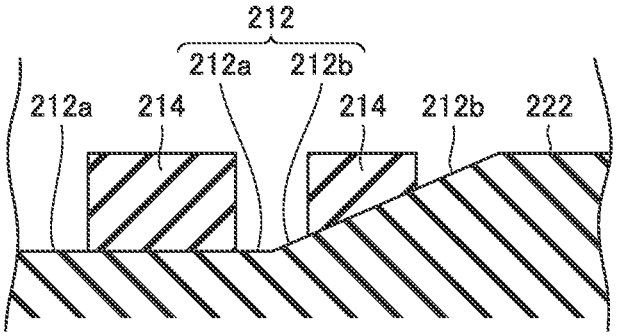
FIG. 6 is a cross-sectional view taken along line VI-VI in FIG. 5.

The recessed surface 212 is located at a height position lower than a surface (including a support surface 220*a* to be described later) of a portion around the shock-absorbing part 210 of the midsole 200. As illustrated in FIG. 6, the recessed surface 212 includes a base surface 212*a* and an inclined surface 212*b*.

The base surface 212*a* is substantially parallel to a surface of each columnar body 214.

Figure 5:
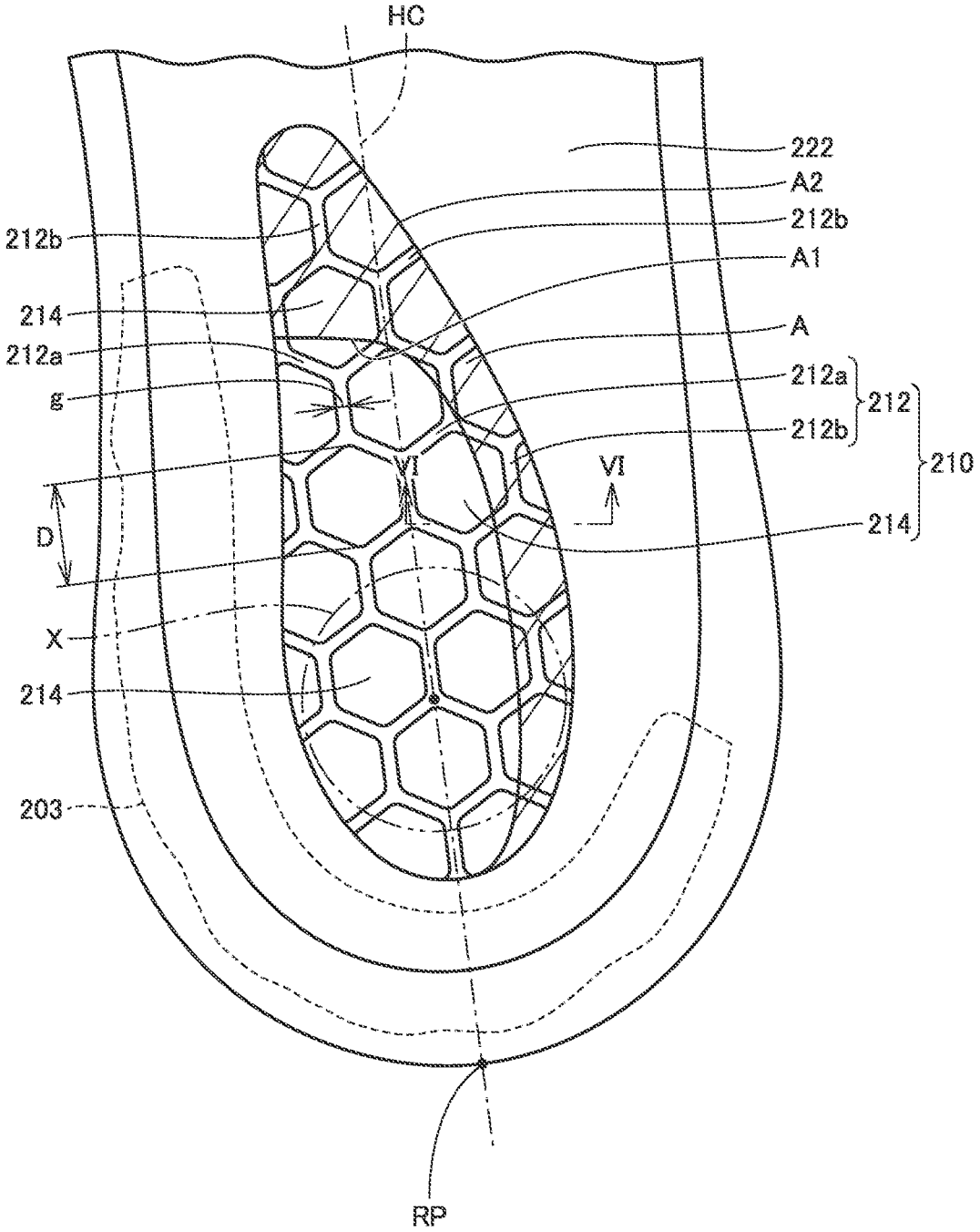
FIG. 5 is a plan view of a shock-absorbing part and a part in the vicinity of the shock-absorbing part.

The inclined surface 212*b* is inclined relative to the base surface 212*a*. The inclined surface 212*b* is formed in a region A (a hatched region in FIG. 5) including the medial edge part 210*c*. The inclined surface 212*b* has a shape inclined so as to gradually come close to the surface of each columnar body 214 while extending from an edge part A1, located in the shock-absorbing part 210, of the region A toward an outer edge A2 of the shock-absorbing part 210. For example, in a cross section taken along line VI-VI in FIG. 5, as illustrated in FIG. 6, the inclined surface 212*b* has a shape inclined so as to gradually come close to the surface of each columnar body 214 while extending from the lateral side toward the medial side in the width direction. The inclined surface 212*b* may be formed flat as illustrated in FIG. 6, may be formed so as to curve upward, or may be formed so as to curve downward. A rear end part of the region A is located on the medial side relative to the center line SC in the width direction.

Each columnar body 214 has a shape extending from the recessed surface 212 to a height position the same in height as the support surface 220*a*. It is preferable that the surface of each columnar body 214 be formed in a polygonal shape as viewed from above, and it is particularly preferable that the surface of each columnar body 214 be formed in a polygonal shape with at least five sides. In the present embodiment, each columnar body 214 is formed in a hexagonal columnar shape. Note that corners of each columnar body 214 are not corners in the strict sense, and may be rounded or chamfered.

Figure 7:
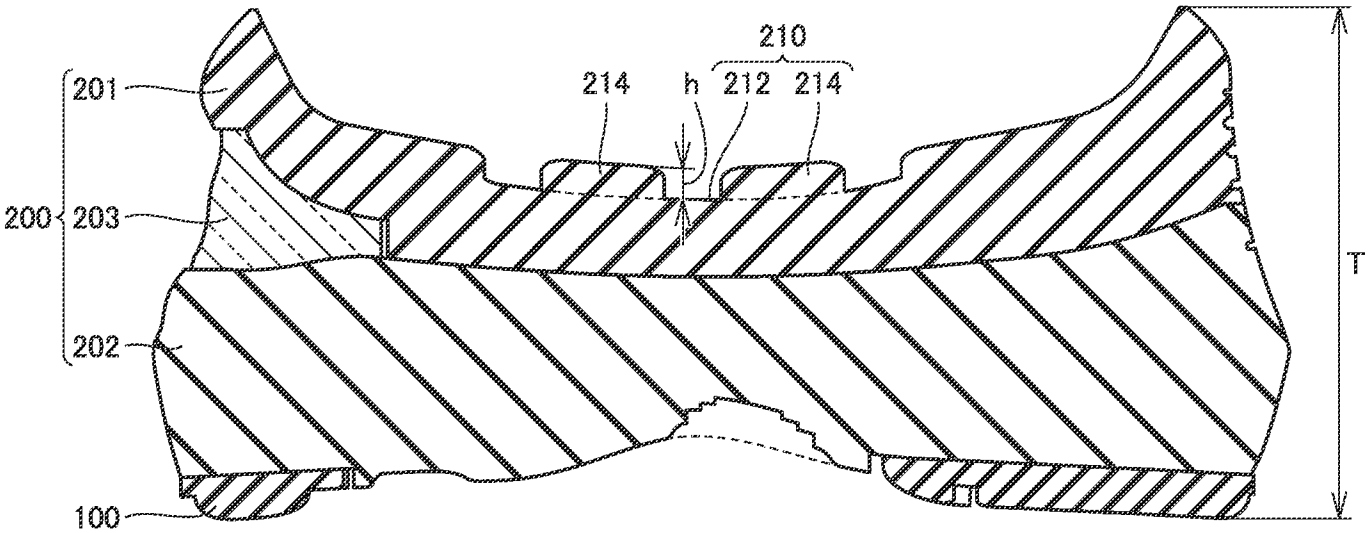
FIG. 7 is an enlarged cross-sectional view of the sole.

A dimension g (see FIG. 5) between a pair of columnar bodies 214 adjacent to each other is greater than or equal to a height dimension h (see FIG. 7) of the columnar bodies 214. The dimension g is less than a length of each side of the surface of each columnar body 214.

In the plan view of the columnar bodies 214, the largest dimension D (see FIG. 5) among the dimensions of the columnar bodies 214 in directions orthogonal to an axial direction of the columnar bodies 214 is greater than or equal to the height dimension h of the columnar bodies 214. The height dimension h is preferably set greater than or equal to 0.5 mm. The height dimension h is set less than or equal to 30% of a thickness T (see FIG. 7) of the sole 10. Note that the height dimension h means a distance from the recessed surface 212 to the surface of each columnar body 214.

A position of the columnar bodies 214 is set such that at least some of the columnar bodies 214 are arranged in a circle X (see FIG. 5) centered on a position corresponding to 15% to 25% of a dimension L (see FIG. 2) in a direction along the center line SC of a portion other than a rolled-up part 101 located at the toes of a contact surface of the outer sole 100 extending forward from a rear end part RP (see FIG. 5) of the contact surface of the outer sole 100 along a heel center HC. A diameter of the circle X is equal to 40% of a dimension between portions intersecting a straight line passing through the center of the edge part of the contact surface of the outer sole 100 and orthogonal to the heel center HC. In the present embodiment, a plurality of the columnar bodies 214 are arranged in the circle X. This circle X is located rearward of a fore end part of the edge part A1 in the longitudinal direction. Note that the heel center HC means a straight line connecting the center of the calcaneus of the typical wearer of the shoe 1, and a gap between the third toe and the fourth toe.

The support part 220 is higher in elastic modulus than the shock-absorbing part 210 and supports the foot. In the present embodiment, the support part 220 supports the midfoot portion of the foot. The support part 220 is provided at least in the midfoot region R3. Note that the elastic modulus is substantially synonymous with a modulus of compressive elasticity of the sole 10 in the thickness direction.

The support part 220 includes the support surface 220*a*. The support surface 220*a* is provided forward of the shock-absorbing part 210. Specifically, the support surface 220*a* constitutes a surface of a portion of the midsole 200 located forward of the shock-absorbing part 210. That is, the recessed surface 212 is located at a height position lower than the support surface 220*a*. The support surface 220*a* has a shape extending from one end to the other end in the width direction.

The support part 220 includes a medial support part 222. The medial support part 222 has a shape extending toward the medial side in the width direction from the medial edge part 210*c*. More specifically, the medial support part 222 has a shape extending toward the medial side in the width direction from the fore edge part 210*c*1. A surface of the medial support part 222 is contiguous with the support surface 220*a*.

Of the midsole 200, the surface of the portion around the shock-absorbing part 210, that is, the surface including the support surface 220*a* and the surface of the medial support part 222 is bonded to the insole 24 with an adhesive. On the other hand, the shock-absorbing part 210 is not bonded to the insole 24.

In the present embodiment, as illustrated in FIGS. 3, 4 and the like, the midsole 200 includes a top midsole 201, a bottom midsole 202, and a cushioning part 203.

The bottom midsole 202 is provided on the outer sole 100.

The top midsole 201 is connected to a surface of a rear of the bottom midsole 202. The shock-absorbing part 210 and the medial support part 222 are formed on a surface of the top midsole 201. The support part 220 is formed in the vicinity of a boundary between the top midsole 201 and the bottom midsole 202 as viewed from above (corresponding to FIG. 2).

The cushioning part 203 is a portion that absorbs an impact mainly applied to the heel upon landing. The cushioning part 203 is made of a material that is lower in hardness than the top midsole 201 and the bottom midsole 202. The cushioning part 203 is made of, for example, a foam material or a non-foam material of a polymer composition.

As illustrated in FIG. 2, the cushioning part 203 is provided around a rear of the shock-absorbing part 210. The cushioning part 203 is provided at a position not overlapping the shock-absorbing part 210 in the thickness direction of the sole 10. In other words, the cushioning part 203 is separated from the shock-absorbing part 210 as viewed from above. Note that the cushioning part 203 may be provided at a position overlapping the shock-absorbing part 210 in the thickness direction.

As described above, in the sole 10 according to the present embodiment, an impact applied to the heel upon landing is cushioned by the shock-absorbing part 210 provided in the rearfoot region R2, and the support part 220 that supports the midfoot portion (arch portion) of the foot includes the support surface 220*a* having a shape extending from one end to the other end of the shoe 1 in the width direction, so that the arch of the foot (medial longitudinal arch and lateral longitudinal arch) is prevented from collapsing.

Figure 8:
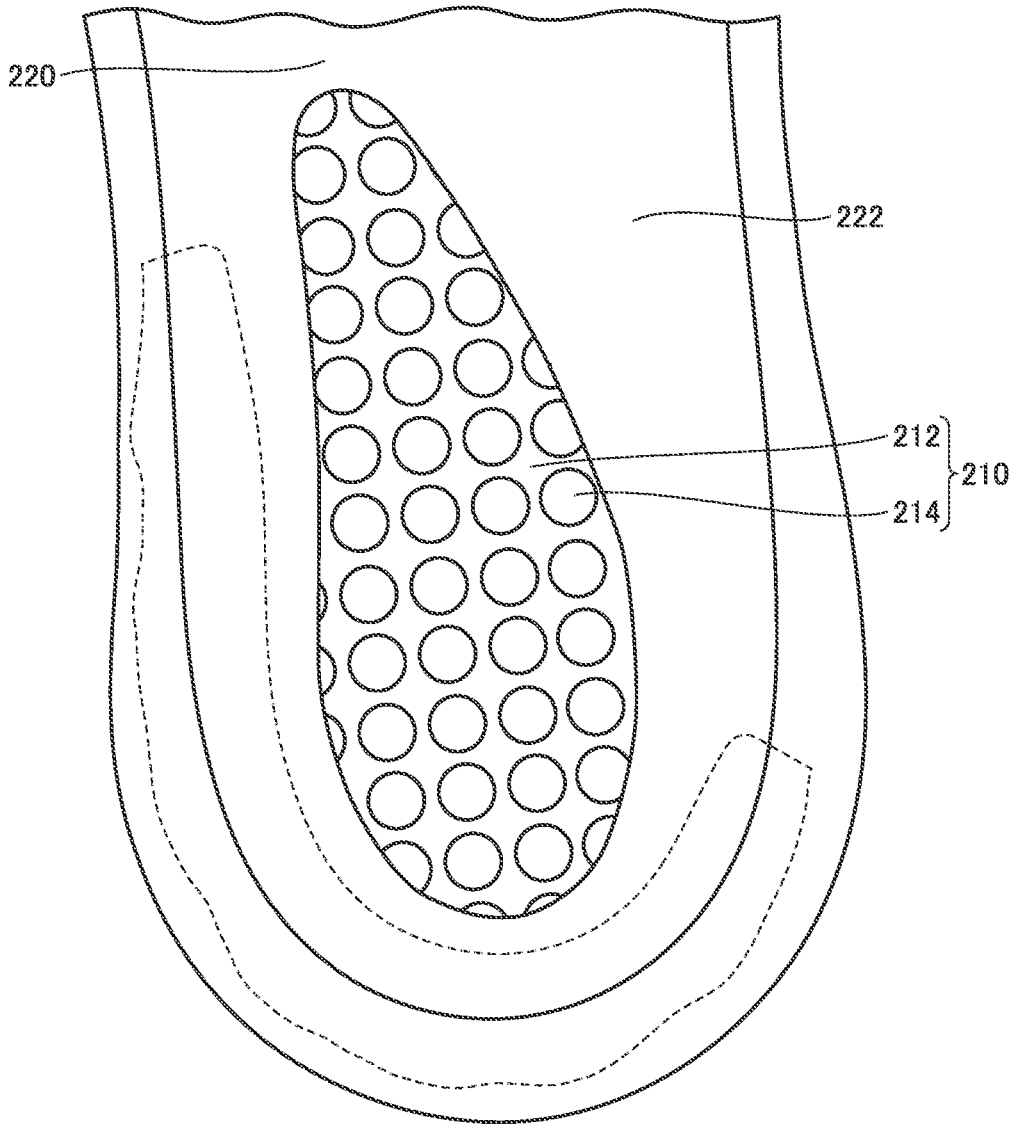
FIG. 8 is a plan view of a modification of a columnar body.
Figure 9:
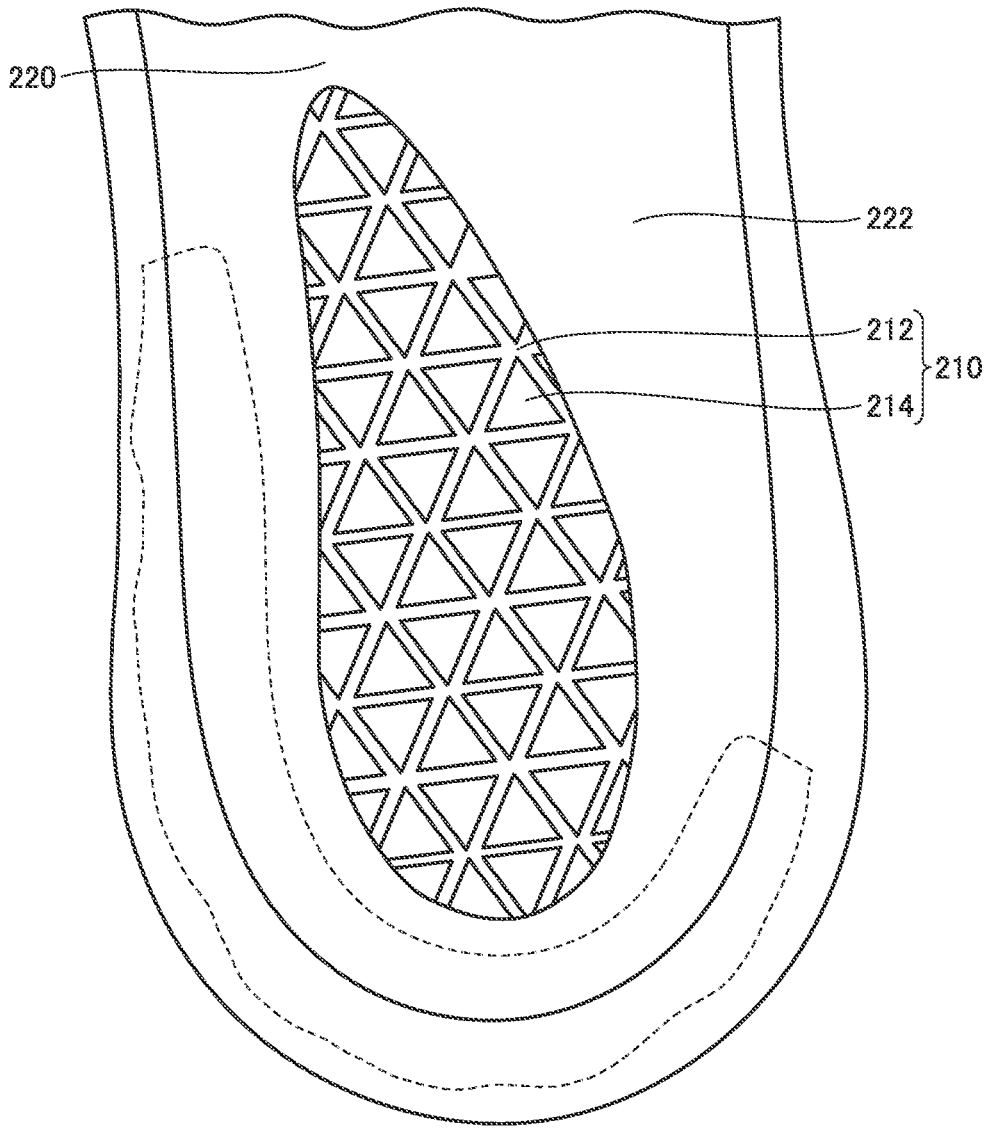
FIG. 9 is a plan view of a modification of the columnar body.

Note that, according to this embodiment, as illustrated in FIG. 8, each columnar body 214 may be formed in the shape of a cylinder. Alternatively, as illustrated in FIG. 9, each columnar body 214 may be formed in the shape of a triangular prism.

Figure 10:
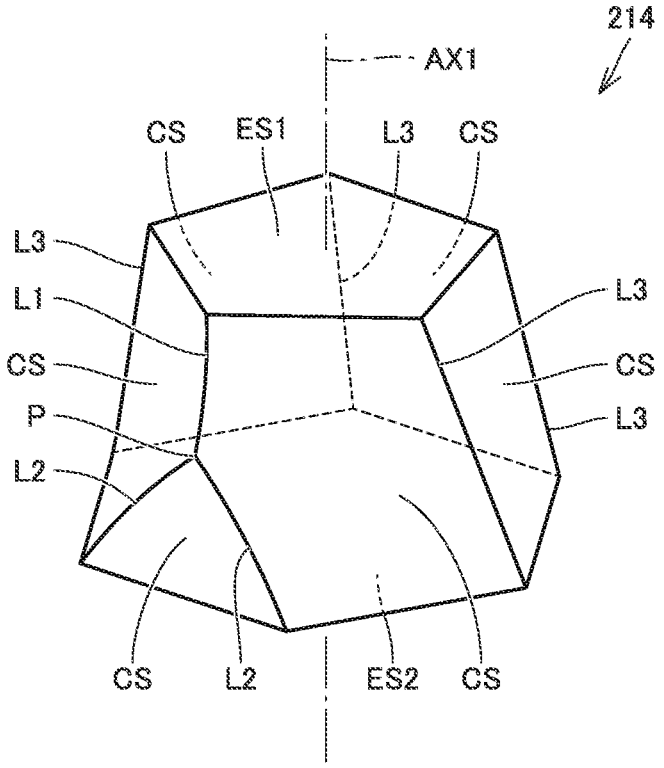
FIG. 10 is a perspective view of a modification of the columnar body.

Alternatively, as illustrated in FIG. 10, each columnar body 214 may include a shock-absorbing member having a columnar outer shape. The shock-absorbing member has, as an outer surface, a first end surface ES1 and a second end surface ES2 on opposite sides of the shock-absorbing member in an axial direction in which an axis AX1 extends, and a plurality of connection surfaces CS connecting a peripheral edge of the first end surface ES1 and a peripheral edge of the second end surface ES2.

The first end surface ES1 has an outer shape of an N-sided polygon (N is an integer greater than or equal to 3) as viewed along the axial direction. The second end surface ES2 has an outer shape of an M-sided polygon (M is an integer greater than or equal to 4 and greater than N) as viewed along the axial direction.

An (M−N) vertex P is provided at an intermediate position in the axial direction of a periphery defined by the plurality of connection surfaces CS. One first ridgeline L1 is provided so as to extend from the (M−N) vertex P to one of the N vertices of the first end surface ES1. Two second ridgelines L2 are provided so as to extend from the (M−N) vertex P to two vertices adjacent to each other in a peripheral direction among the M vertices of the second end surface ES2. (2*N−M) third ridgelines L3 are provided so as to extend from the remaining vertices of the N vertices of the first end surface ES1 to the remaining vertices of the M vertices of the second end surface ES2.

Ridgelines included in the first ridgeline L1, the second ridgelines L2, and the third ridgelines L3 do not intersect each other, and the plurality of connection surfaces CS are defined by the ridgelines included in the first ridgeline L1, the second ridgelines L2, and the third ridgelines L3.

In the example illustrated in FIG. 10, the first end surface ES1 is a flat surface having a pentagonal outer shape as viewed along the axial direction, and the second end surface ES2 is a flat surface having a hexagonal outer shape as viewed along the axial direction. That is, in this example, N is 5, and M is 6. Further, the number of vertices P is 1. The plurality of connection surfaces CS include a total of six curved surfaces including one curved surface having an approximately triangular outer shape, three curved surfaces having an approximately quadrangular outer shape, and two curved surfaces having an approximately pentagonal outer shape.

When a compressive load is applied to the shock-absorbing member along the axial direction, not only a stress field in which compressive deformation occurs in the shock-absorbing member along the axial direction but also a stress field in which shear deformation occurs are generated. This is because all of the plurality of connection surfaces CS each extend in a direction intersecting the axial direction, and thus a complicated stress field is generated due to such an outer shape. In other words, since a main axis of deformation of the shock-absorbing member is different from a load direction (that is, the axial direction of the shock-absorbing member), shearing deformation is much more likely to occur as compared with a polygonal or cylindrical shock-absorbing member in which the main axis coincides with the load direction.

Therefore, the more likely shear deformation is to occur, the larger the amount of deformation per volume, and high deformability is obtained accordingly. As a result, when each columnar body 214 is set as the above-described shock-absorbing member, a high shock-absorbing capability is exhibited.

Figure 11:
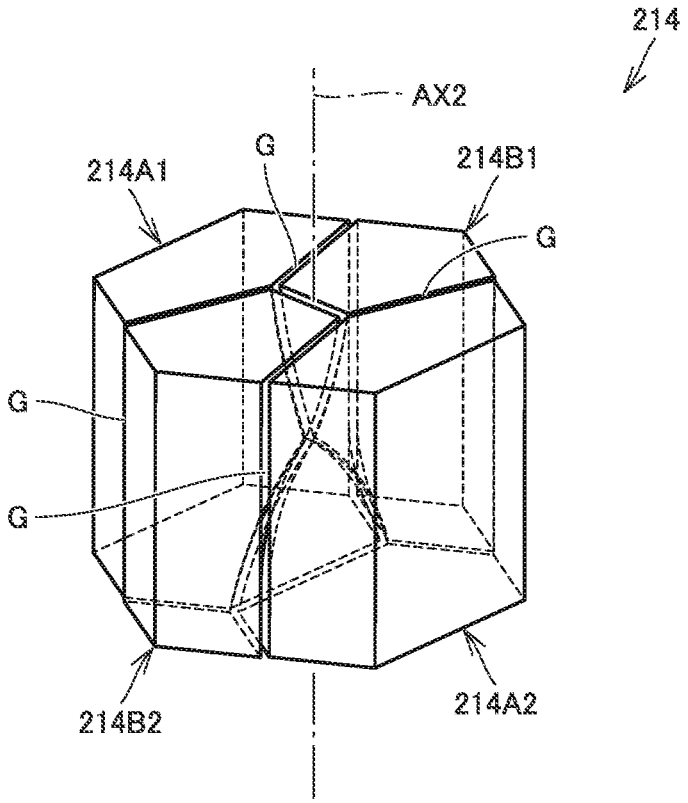
FIG. 11 is a perspective view of a modification of the columnar body.
Figure 12:
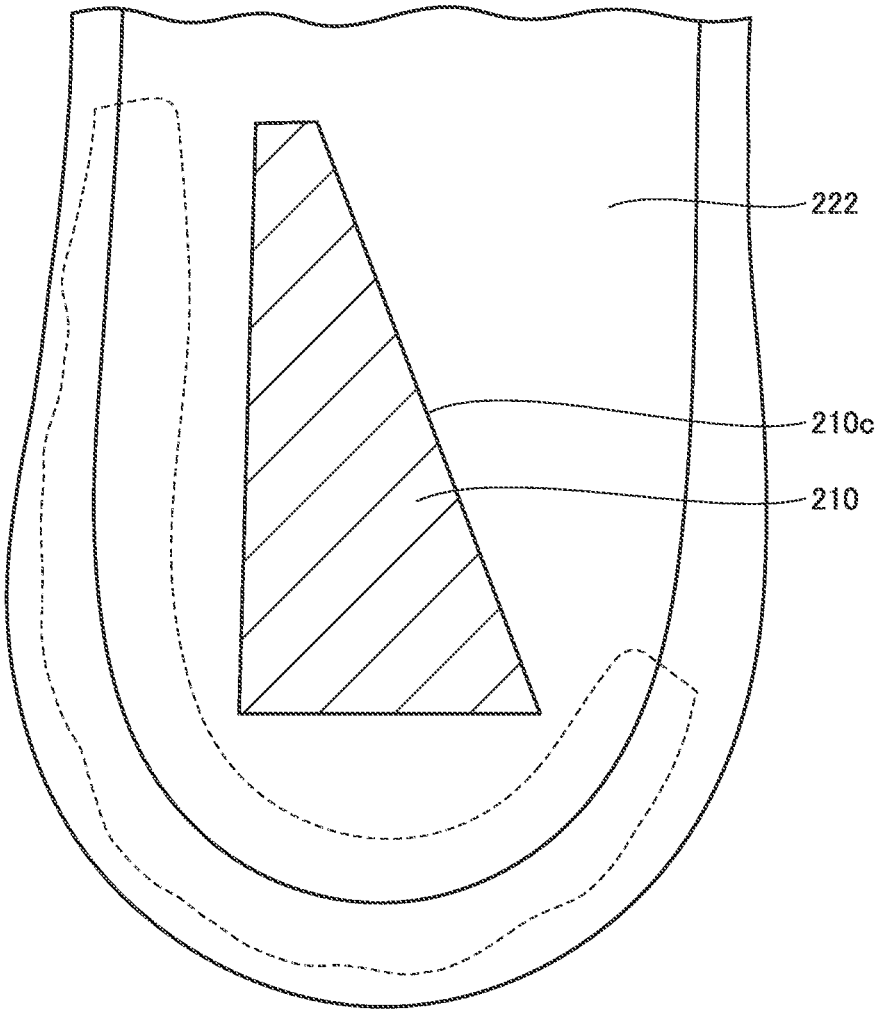
FIG. 12 is a diagram illustrating a modification of a region of the shock-absorbing part.
Figure 13:
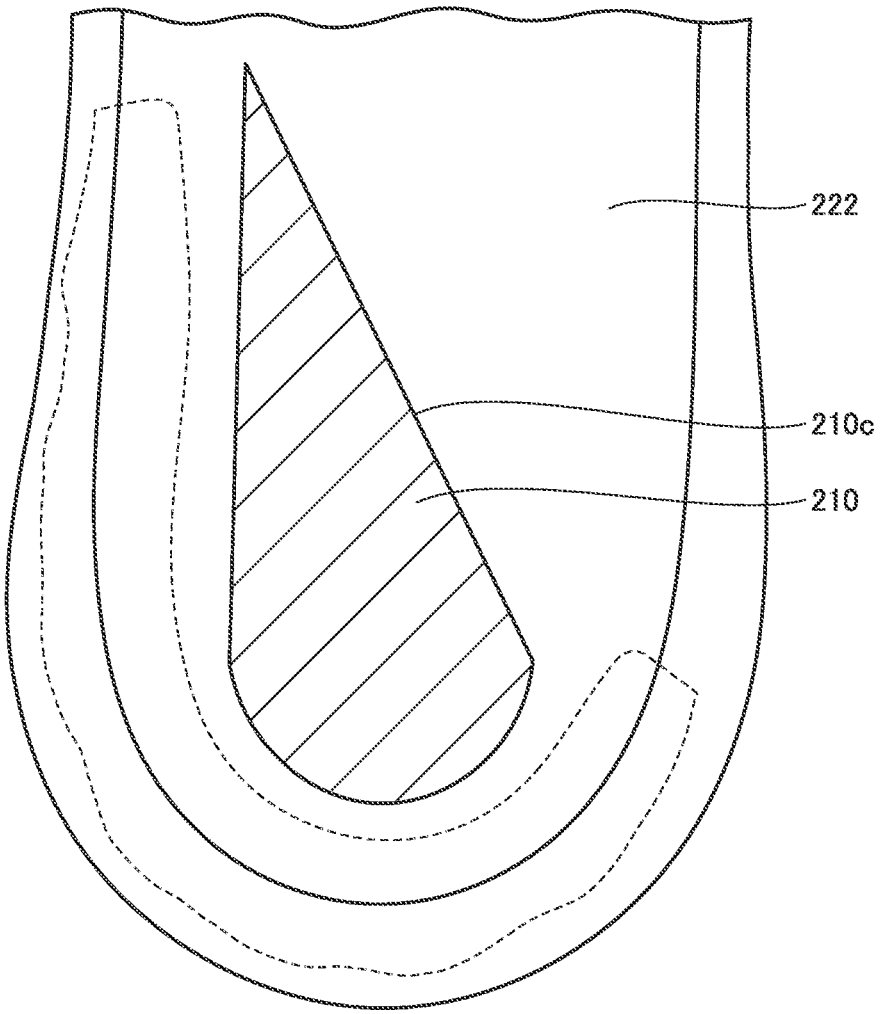
FIG. 13 is a diagram illustrating a modification of the region of the shock-absorbing part.
Figure 14:
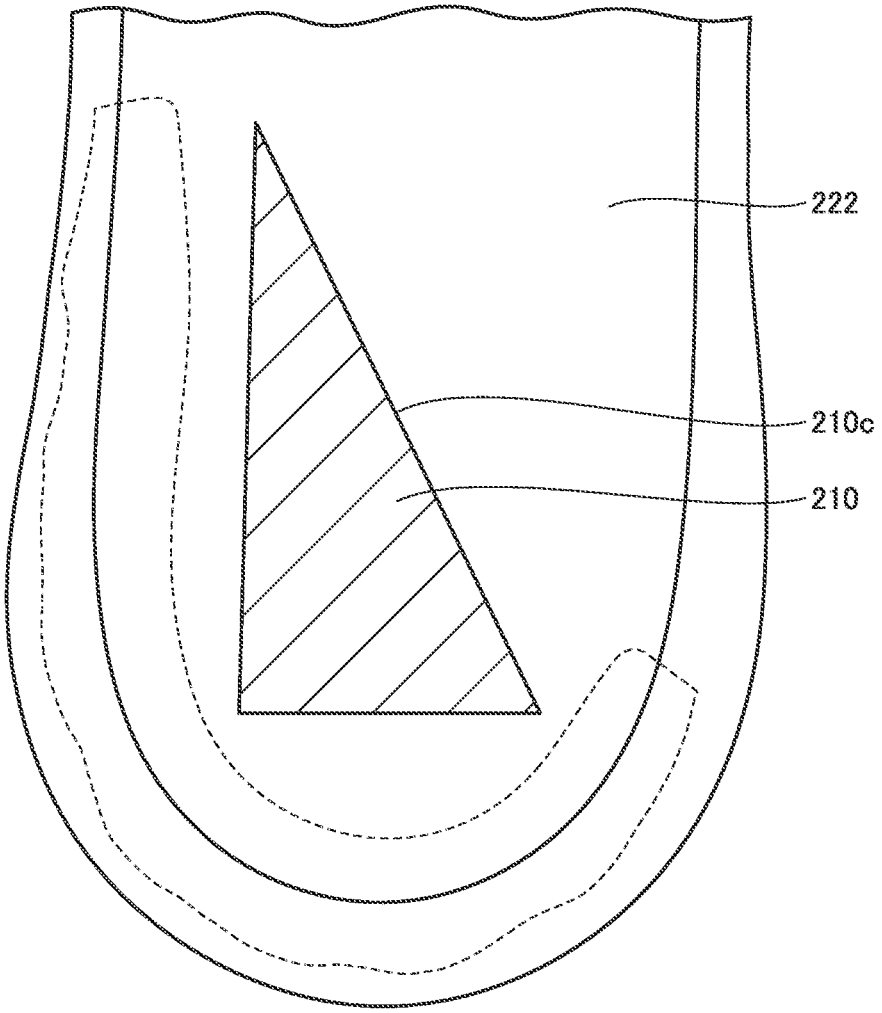
FIG. 14 is a diagram illustrating a modification of the region of the shock-absorbing part.
Figure 15:
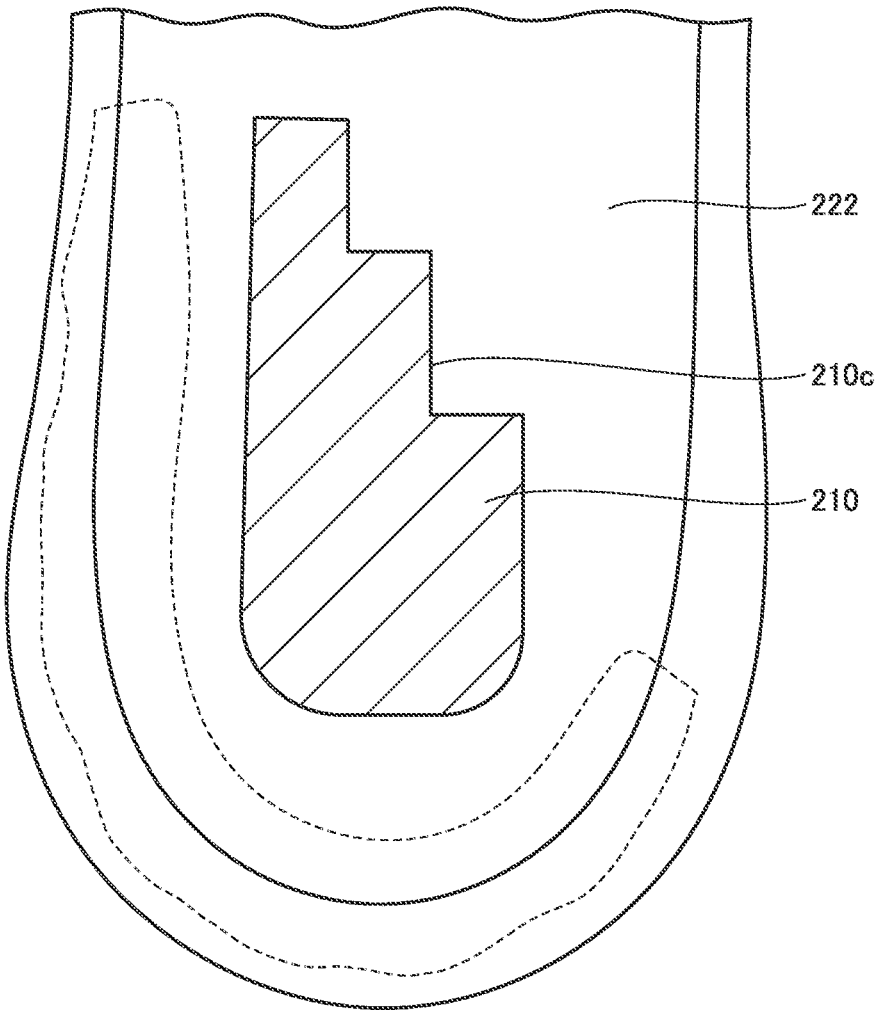
FIG. 15 is a diagram illustrating a modification of the region of the shock-absorbing part.

Alternatively, as illustrated in FIG. 11, each columnar body 214 may be formed of a shock-absorbing structure including a shock-absorbing unit obtained by unitizing a plurality of shock-absorbing members.

Each of the plurality of shock-absorbing members includes the shock-absorbing member illustrated in FIG. 10. The plurality of shock-absorbing members are arranged adjacent to each other so as to cause connection surfaces defined by the first ridgeline L1 and the second ridgelines L2 among the plurality of connection surfaces CS included in each shock-absorbing member to face each other with a gap G provided between the connection surfaces. A size of each gap G is approximately uniform.

In the example illustrated in FIG. 11, the plurality of shock-absorbing members include a total of four shock-absorbing members including two first shock-absorbing members each having the first end surface ES1 with a pentagonal shape and the second end surface ES2 with a hexagonal shape, and two second shock-absorbing members each having the first end surface ES1 with a quadrangular shape and the second end surface ES2 with a pentagonal shape. The two first shock-absorbing members and the two second shock-absorbing members are alternately arranged so as to surround an axis AX2 of the shock-absorbing unit and to make the two first shock-absorbing members and the two second shock-absorbing members opposite in orientation along the axial direction to each other. This causes the shock-absorbing unit to have an approximately hexagonal columnar outer shape as a whole.

This aspect also enhances the shock-absorbing capability of the shock-absorbing part 210.

Further, as illustrated in FIGS. 12 to 15, the formation region of the shock-absorbing part 210 can be variously changed.

Second Embodiment

Figure 16:
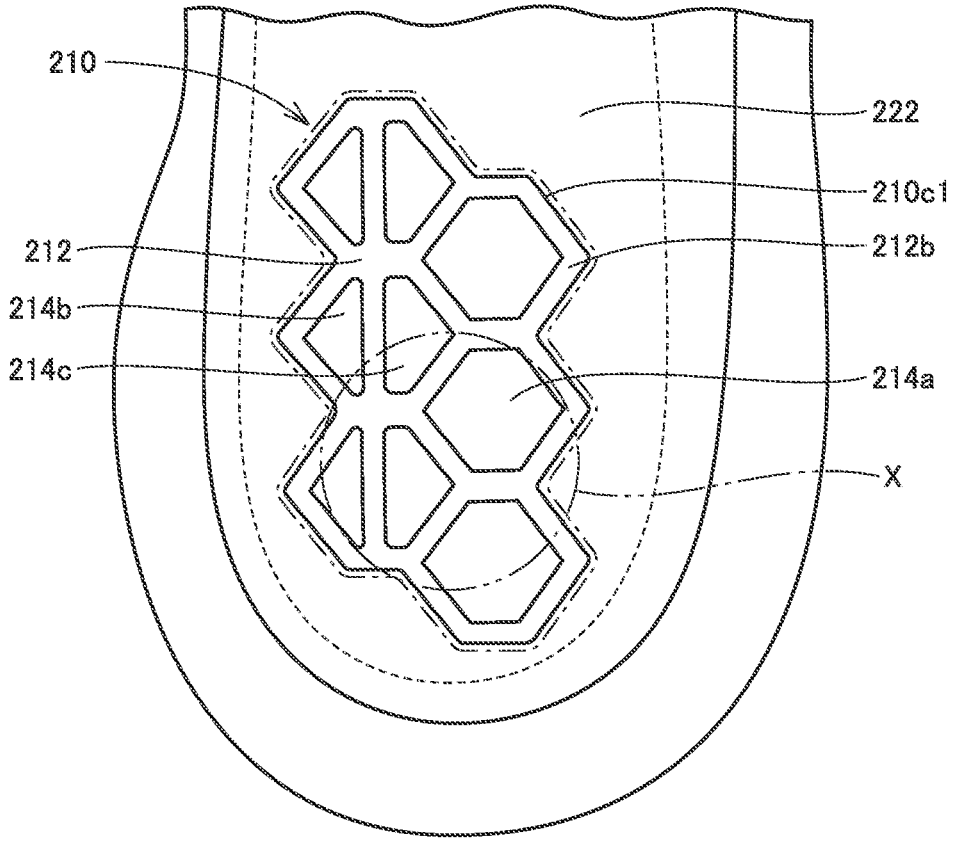
FIG. 16 is a plan view of a shock-absorbing part of a sole of a shoe according to a second embodiment of the present disclosure.

Next, a shock-absorbing part 210 of a sole 10 according to a second embodiment of the present disclosure will be described with reference to FIG. 16. In the second embodiment, only parts different from those of the first embodiment will be described, and the description of the same structure, operation, and effect as those of the first embodiment will not be repeated.

In the present embodiment, the plurality of columnar bodies 214 of the shock-absorbing part 210 includes three medial columnar bodies 214*a* arranged so as to be aligned along the longitudinal direction on the medial side in the width direction, three lateral columnar bodies 214*b* arranged so as to be aligned along the longitudinal direction on the lateral side in the width direction, and three central columnar bodies 214*c* arranged so as to be aligned along the longitudinal direction between the medial columnar bodies 214*a* and the lateral columnar bodies 214*b*. A surface of each lateral columnar body 214*b* as viewed from above is formed in a triangular shape. A surface of each central columnar body 214*c* as viewed from above is formed in an approximately pentagonal shape. A recessed surface 212 is provided between the lateral columnar bodies 214*b* and the central columnar bodies 214*c*. An overall outer shape of a pair of the lateral columnar body 214*b* and the central columnar body 214*c* adjacent to each other in the width direction with the recessed surface 212 interposed between the lateral columnar body 214*b* and the central columnar body 214*c* is formed in an approximately hexagonal columnar shape.

Third Embodiment

Next, a shock-absorbing part 210 of a sole 10 according to a third embodiment of the present disclosure will be described with reference to FIGS. 17 to 19. In the third embodiment, only parts different from those of the first embodiment will be described, and the description of the same structure, operation, and effect as those of the first embodiment will not be repeated.

In the present embodiment, the support surface 220*a* is provided around the shock-absorbing part 210, and the shock-absorbing part 210 includes a high-elastic region 210H and a low-elastic region 210L. Note that, in FIG. 17, the outer shape of the low-elastic region 210L is indicated by a thick line.

The high-elastic region 210H is located adjacent to the support surface 220*a*. The structure of the high-elastic region 210H is the same as in the first embodiment. That is, the high-elastic region 210H includes a recessed surface 212 and a plurality of columnar bodies 214H. The high-elastic region 210H is shaped to surrounding the entire perimeter of the low-elastic region 210L.

The low-elastic region 210L is located adjacent to the high-elastic region 210H and is lower in elastic modulus than the high-elastic region 210H. The low-elastic region 210L has an Asker C hardness of about HC 25 to HC 40. The low-elastic region 210L is formed at a position overlapping the calcaneus of the wearer of the shoe 1 in the thickness direction of the sole 10. In the present embodiment, the low-elastic region 210L includes four columnar bodies 214L.

The low-elastic region 210L may be made of basically any material as long as the material is rich in elasticity, and may be made of a resin foam such as a polyolefin resin, a polyurethane resin, a nylon resin, or an ethylene-vinyl acetate copolymer that is the same as the material of the high-elastic region 210H. In this case, as will be described later, the low-elastic region 210L is hollowed, or a foaming rate of the material of the low-elastic region 210L is adjusted, so as to make the low-elastic region 210L lower in elastic modulus than the high-elastic region 210H. In a case where both the low-elastic region 210L and the high-elastic region 210H are made of the same material, the low-elastic region 210L and the high-elastic region 210H may be formed integrally or separately.

The low-elastic region 210L is preferably formed of a polymer composition. In this case, examples of the polymer to be contained in the polymer composition include olefin-based polymers such as an olefin-based elastomer and an olefin-based resin. Examples of the olefin-based polymer include polyolefins such as polyethylene (for example, linear low density polyethylene (LLDPE), high density polyethylene (HDPE), and the like), polypropylene, an ethylene-propylene copolymer, a propylene-1-hexene copolymer, a propylene-4-methyl-1-pentene copolymer, a propylene-1-butene copolymer, an ethylene-1-hexene copolymer, an ethylene-4-methyl-pentene copolymer, an ethylene-1-butene copolymer, a 1-butene-1-hexene copolymer, a 1-butene-4-methyl-pentene, an ethylene methacrylate copolymer, an ethylene-methyl methacrylate copolymer, an ethylene-ethyl methacrylate copolymer, an ethylene-butyl methacrylate copolymer, an ethylene-methyl acrylate copolymer, an ethylene-ethyl acrylate copolymer, an ethylene-butyl acrylate copolymer, a propylene methacrylate copolymer, a propylene-methyl methacrylate copolymer, a propylene-ethyl methacrylate copolymer, a propylene-butyl methacrylate copolymer, a propylene-methyl acrylate copolymer, a propylene-ethyl acrylate copolymer, a propylene-butyl acrylate copolymer, an ethylene-vinyl acetate copolymer (EVA), and a propylene-vinyl acetate copolymer.

Further, the above-described polymer may be, for example, an amide-based polymer such as an amide-based elastomer or an amide-based resin. Examples of the amide-based polymer include polyamide 6, polyamide 11, polyamide 12, polyamide 66, and polyamide 610.

Further, the above-described polymer may be, for example, an ester-based polymer such as an ester-based elastomer or an ester-based resin. Examples of the ester-based polymer include polyethylene terephthalate and polybutylene terephthalate.

Further, the above-described polymer may be, for example, a urethane-based polymer such as a urethane-based elastomer or a urethane-based resin. Examples of the urethane-based polymer include polyester-based polyurethane and polyether-based polyurethane.

Further, the above-described polymer may be, for example, a styrene-based polymer such as a styrene-based elastomer or a styrene-based resin. Examples of the styrene-based elastomer include a styrene-ethylene-butylene copolymer (SEB), a styrene-butadiene-styrene copolymer (SBS), a hydrogenated product of SBS (styrene-ethylene-butylene-styrene copolymer (SEBS)), a styrene-isoprene-styrene copolymer (SIS), a hydrogenated product of SIS (styrene-ethylene-propylene-styrene copolymer (SEPS)), a styrene-isobutylene-styrene copolymer (SIBS), styrene-butadiene-styrene-butadiene (SBSB), and styrene-butadiene-styrene-butadiene-styrene (SBSBS). Examples of the styrene-based resin include polystyrene, an acrylonitrile-styrene resin (AS), and an acrylonitrile-butadiene-styrene resin (ABS).

Further, the above-described polymer may be, for example, an acrylic polymer such as polymethyl methacrylate, a urethane-based acrylic polymer, a polyester-based acrylic polymer, a polyether-based acrylic polymer, a polycarbonate-based acrylic polymer, an epoxy-based acrylic polymer, a conjugated diene polymerization-based acrylic polymer and hydrogenated products thereof, a urethane-based methacrylic polymer, a polyester-based methacrylic polymer, a polyether-based methacrylic polymer, a polycarbonate-based methacrylic polymer, an epoxy-based methacrylic polymer, a conjugated diene polymerization-based methacrylic polymer and hydrogenated products thereof, a polyvinyl chloride-based resin, a silicone-based elastomer, a butadiene rubber (BR), an isoprene rubber (IR), a chloroprene (CR), a natural rubber (NR), a styrene butadiene rubber (SBR), an acrylonitrile butadiene rubber (NBR), a butyl rubber (IIR), or the like.

Figure 17:
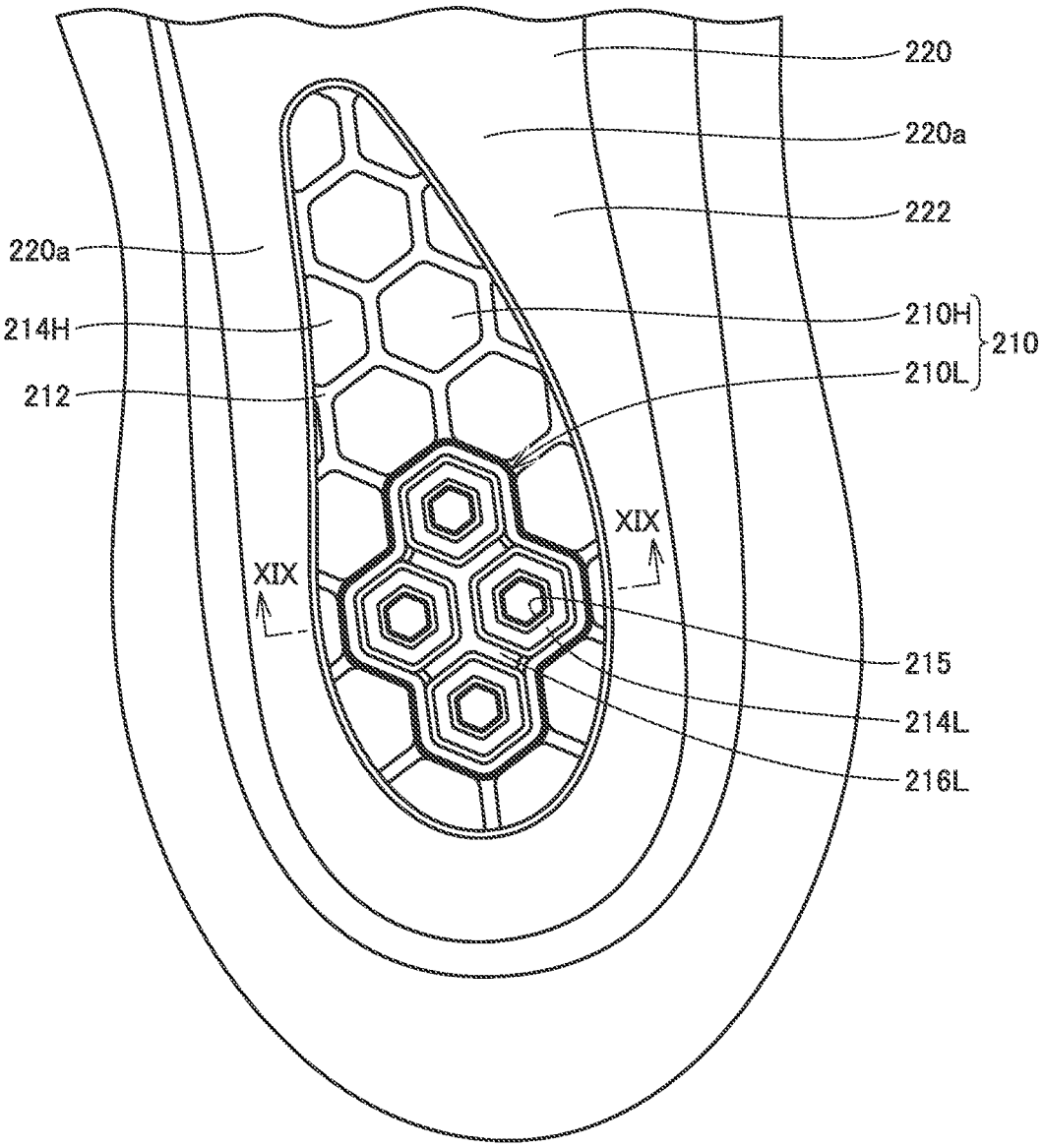
FIG. 17 is a plan view of a shock-absorbing part of a sole of a shoe according to a third embodiment of the present disclosure.
Figure 18:
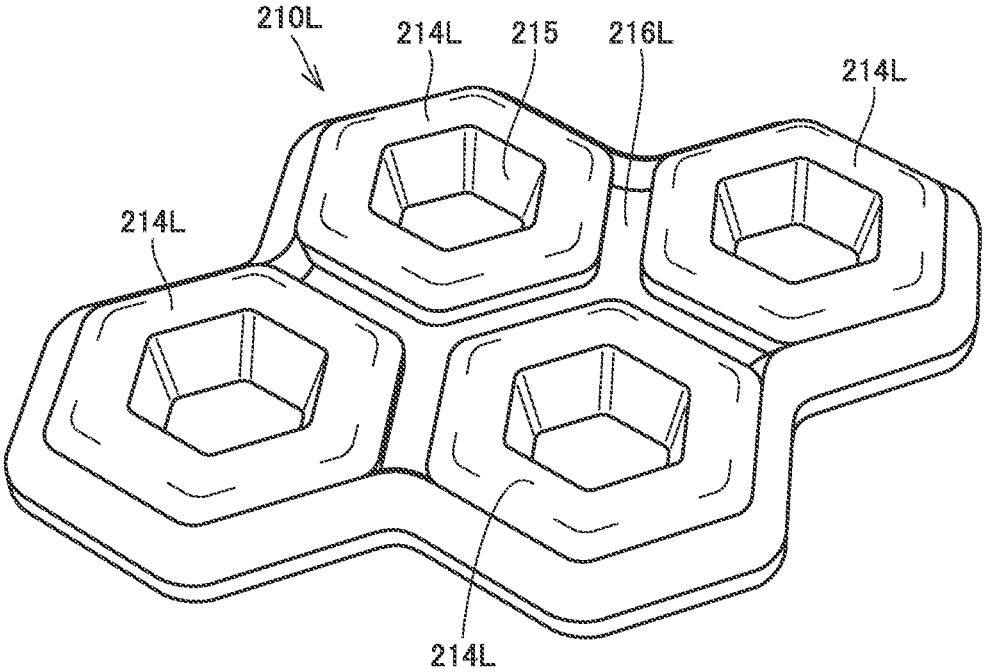
FIG. 18 is a perspective view of a low-elastic region of the shock-absorbing part.
Figure 19:
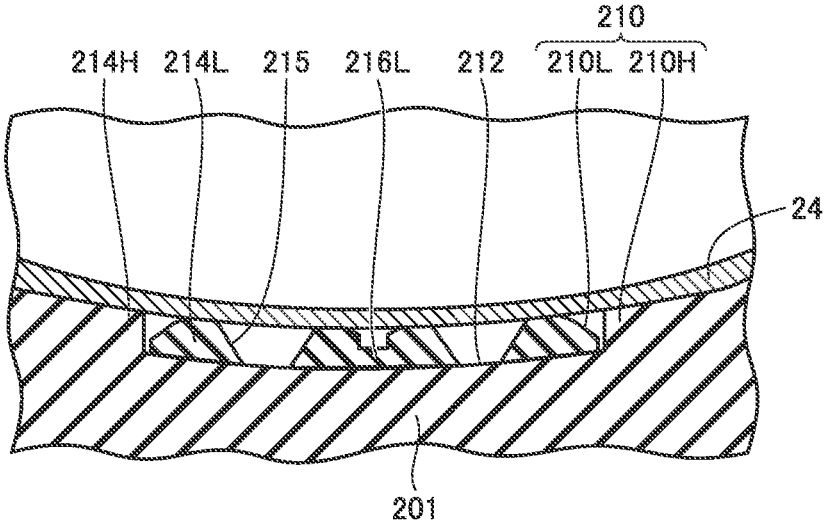
FIG. 19 is a cross-sectional view taken along line XIX-XIX in FIG. 17.

As illustrated in FIGS. 17 to 19, each columnar body 214L in the low-elastic region 210L includes a hollowed part 215. The hollowed part 215 is formed of a through hole extending through a corresponding columnar body 214L in the thickness direction of the sole 10. Note that the hollowed part 215 may be formed of a recessed part recessed from the surface of the columnar body 214L toward the recessed surface 212.

An inner peripheral surface of the columnar body 214L that defines the hollowed part 215 is inclined such that the hollowed part 215 gradually becomes larger as the distance from the recessed surface 212 increases. An outer surface of the columnar body 214L is inclined so as to become gradually wider as the distance to the recessed surface 212 decreases. Note that the inner peripheral surface and the outer surface may be orthogonal to the recessed surface 212.

The low-elastic region 210L includes a connecting part 216L that connects the columnar bodies 214L adjacent to each other. As illustrated in FIG. 19, the connecting part 216L is smaller in thickness than each columnar body 214L.

As described above, in the sole 10 according to the present embodiment, the shock-absorbing part 210 cushions the impact applied to the foot upon landing. Furthermore, since the shock-absorbing part 210 includes the high-elastic region 210H located adjacent to the support surface 220*a* and the low-elastic region 210L located adjacent to the high-elastic region 210H, a difference in elastic modulus among the support part 220, the high-elastic region 210H, and the low-elastic region 210L becomes smaller. This reduces the sense of discomfort felt by the wearer.

Figure 20:
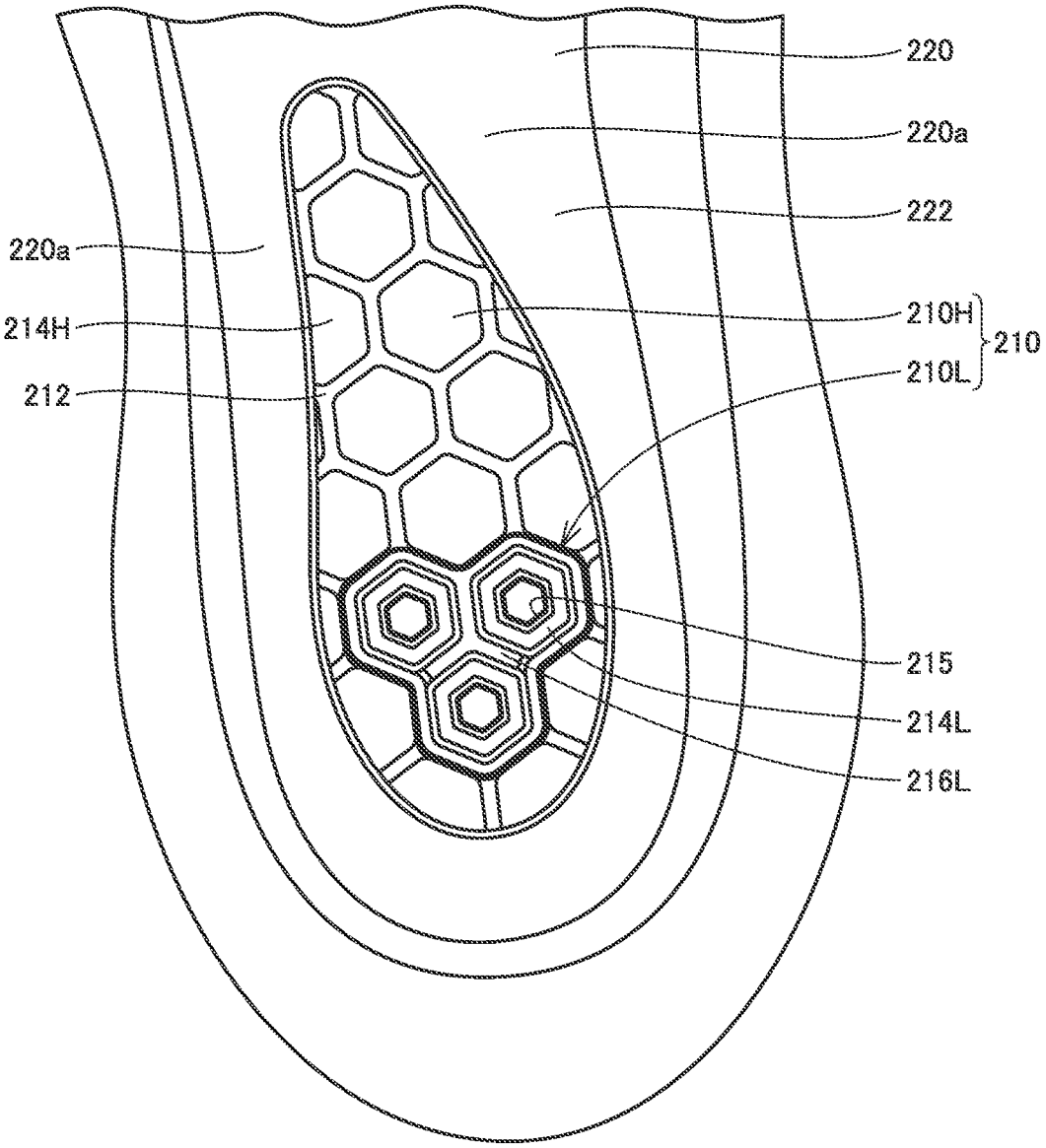
FIG. 20 is a diagram illustrating a modification of the low-elastic region.

Furthermore, as illustrated in FIG. 20, the low-elastic region 210L may include three columnar bodies 214L.

Figure 21:
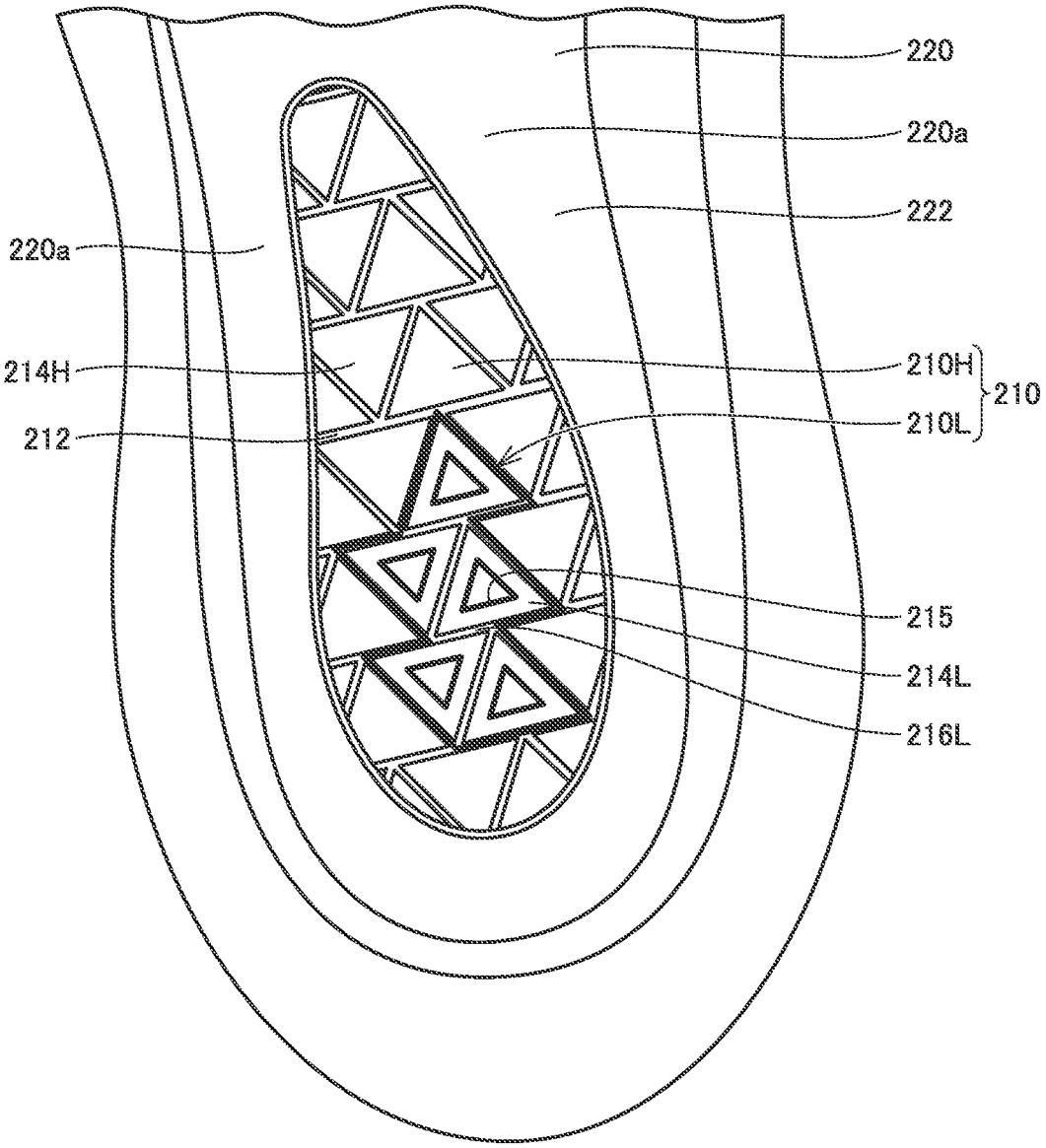
FIG. 21 is a diagram illustrating a modification of the low-elastic region.

Further, in the present embodiment, the columnar bodies 214H in the high-elastic region 210H and the columnar bodies 214L in the low-elastic region 210L are not limited to hexagonal columns. For example, each of the columnar bodies 214H and 214L may be formed in the shape of a triangular prism as illustrated in FIG. 21, or may be formed in the shape of a cylinder although not illustrated in the drawing. It is preferable that, as in the first embodiment, the surface of each of the columnar bodies 214H and 214L be formed in a polygonal shape as viewed from above, and it is particularly preferable that the surface be formed in a polygonal shape with at least five sides.

Further, the formation position of the low-elastic region 210L is not limited to the rearfoot region R2. As illustrated in FIGS. 22 to 25, the low-elastic region 210L may be formed in a region extending from the forefoot region R1 to the midfoot region R3. In such aspects, the impact applied to the forefoot portion or the midfoot portion is cushioned.

Figure 22:
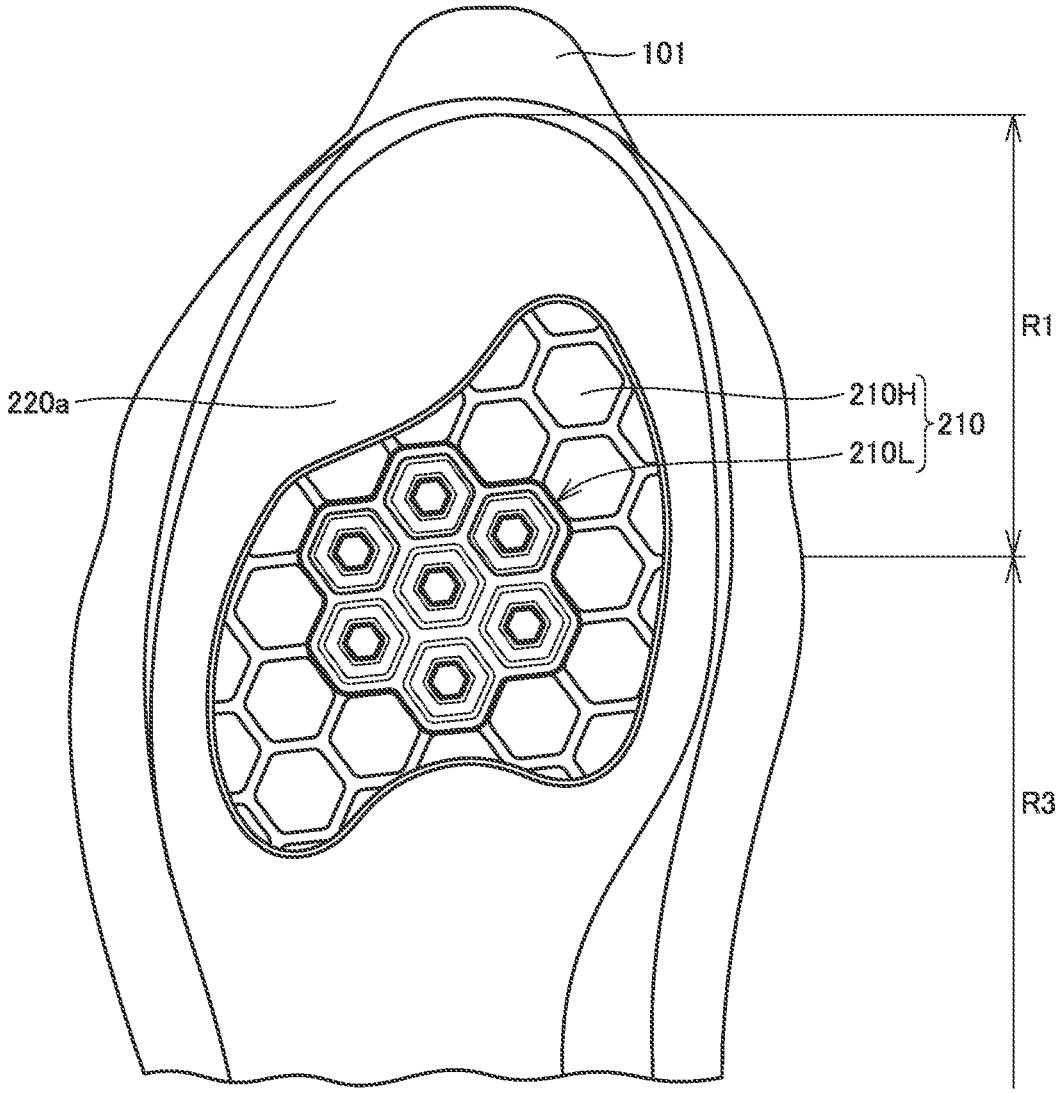
FIG. 22 is a plan view illustrating a modification of the arrangement of the shock-absorbing part and the low-elastic region.
Figure 23:
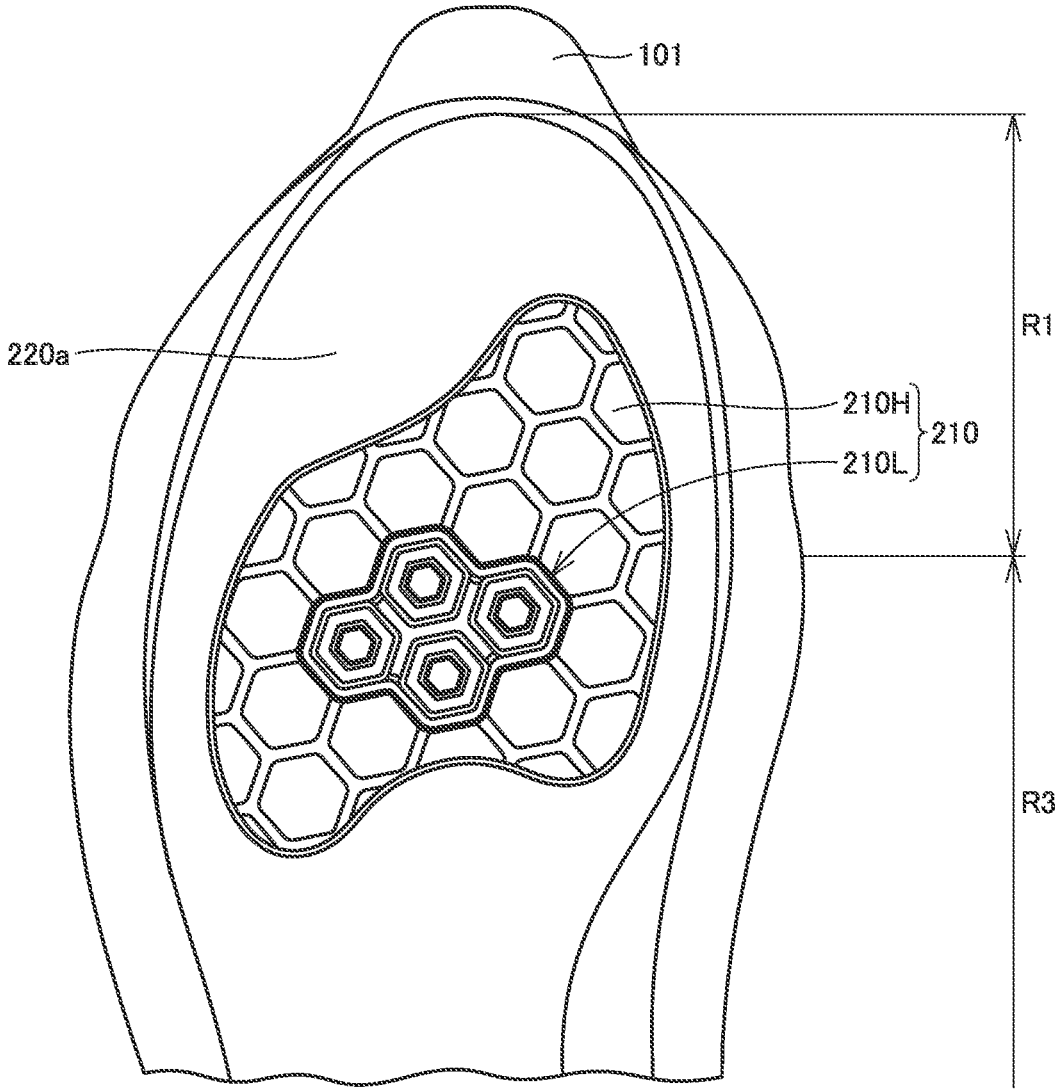
FIG. 23 is a plan view illustrating a modification of the arrangement of the shock-absorbing part and the low-elastic region.

In the example illustrated in FIG. 22, the low-elastic region 210L is provided at a center portion of the shock-absorbing part 210 in a foot width direction, and includes seven columnar bodies 214L. In the example illustrated in FIG. 23, the low-elastic region 210L is provided at the center portion of the shock-absorbing part 210 in the foot width direction, and includes four columnar bodies 214L. In the example illustrated in FIG. 24, the low-elastic region 210L is provided at a lateral foot side region of the shock-absorbing part 210 in the foot width direction, and includes four columnar bodies 214L. In the example illustrated in FIG. 25, the low-elastic region 210L is provided at a medial foot side region of the shock-absorbing part 210 in the foot width direction, and includes four columnar bodies 214L.

Figure 24:
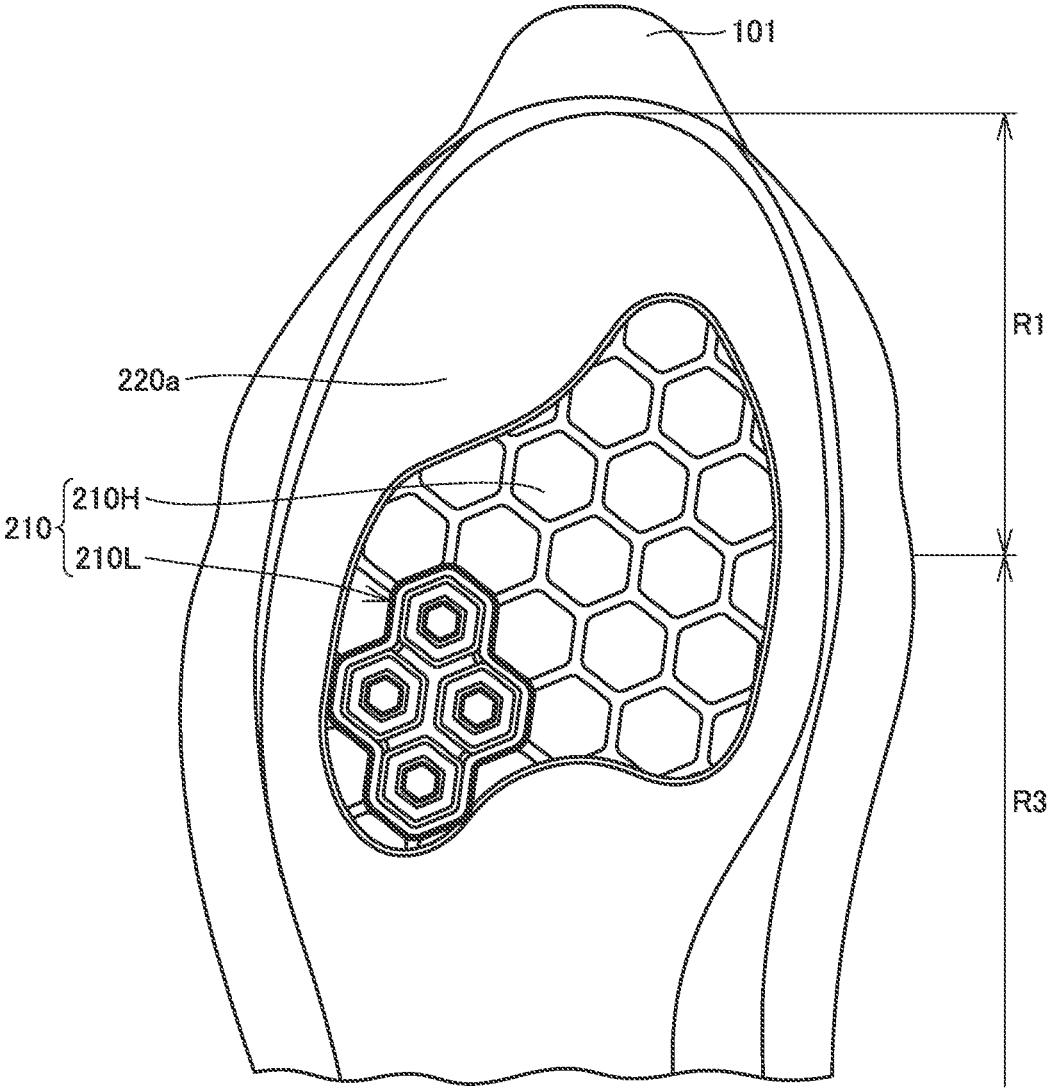
FIG. 24 is a plan view illustrating a modification of the arrangement of the shock-absorbing part and the low-elastic region.

Further, the low-elastic region 210L need not be entirely surrounded by the high-elastic region 210H. As illustrated in FIG. 24, a part of the low-elastic region 210L may be directly adjacent to the support surface 220*a*. Note that, in the examples illustrated in FIGS. 22, 23, and 25, the perimeter of the low-elastic region 210L is entirely surrounded by the high-elastic region 210H.

Figure 25:
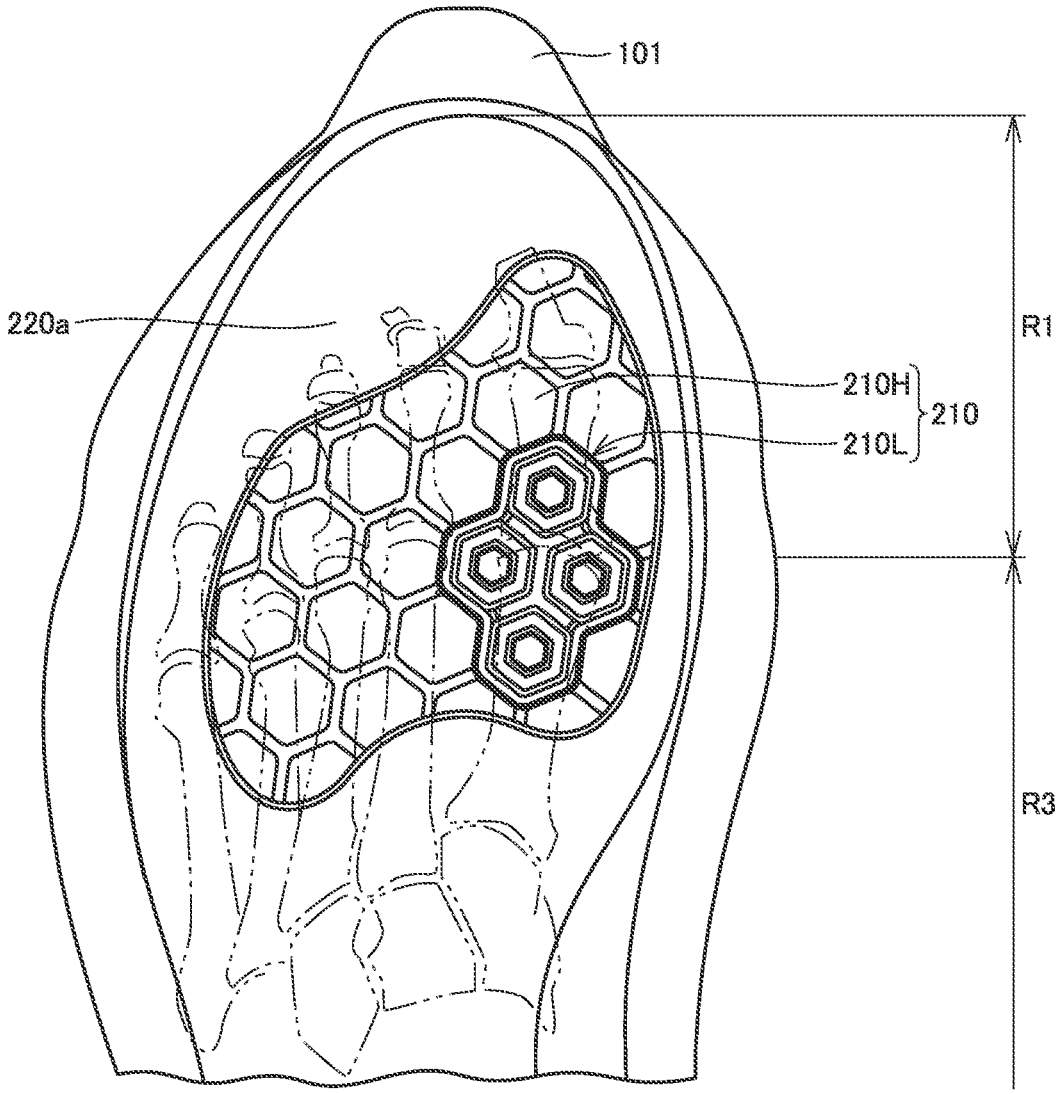
FIG. 25 is a plan view illustrating a modification of the arrangement of the shock-absorbing part and the low-elastic region.

Further, as illustrated in FIG. 25, the low-elastic region 210L may be formed at a position overlapping a thenar of the wearer of the shoe 1.

Aspect

It is to be understood by those skilled in the art that the plurality of exemplary embodiments described above are specific examples of the following aspects.

A sole according to one aspect of this disclosure is a sole constituting a part of a shoe, the sole including: a shock-absorbing part that cushions an impact applied to a foot upon landing; and a support part that is higher in elastic modulus than the shock-absorbing part and supports the foot, in which the support part includes a support surface provided around the shock-absorbing part, the shock-absorbing part includes: a recessed surface located at a height position lower than the support surface; and a plurality of columnar bodies each having a shape extending from the recessed surface to a height position identical in height to the support surface, and the shock-absorbing part includes: a high-elastic region that is located adjacent to the support surface; and a low-elastic region that is located adjacent to the high-elastic region and lower in elastic modulus than the high-elastic region.

This sole causes the shock-absorbing part to cushion the impact applied to the foot upon landing. Furthermore, since the shock-absorbing part includes the high-elastic region located adjacent to the support surface and the low-elastic region located adjacent to the high-elastic region, a difference in elastic modulus among the support part, the high-elastic region, and the low-elastic region becomes smaller. This reduces the sense of discomfort felt by the wearer.

Further, it is preferable that each of the columnar bodies in the low-elastic region include a hollowed part. In this case, the hollowed part may be formed of a through hole extending through a corresponding one of the columnar bodies in a thickness direction of the sole.

Further, it is preferable that the low-elastic region be formed of a material lower in hardness than a material of the high-elastic region.

Further, it is preferable that the high-elastic region be shaped to surround an entire perimeter of the low-elastic region.

Accordingly, the sense of discomfort felt by the wearer is more reliably reduced.

Further, the shock-absorbing part may be provided in a rearfoot region overlapping a rearfoot portion of the wearer of the shoe in the thickness direction of the sole.

In this aspect, the impact applied to the rearfoot portion is cushioned. In this case, it is preferable that the low-elastic region be formed at a position overlapping the calcaneus of the wearer of the shoe in the thickness direction of the sole.

In this aspect, in particular, the impact applied to the heel is effectively cushioned.

Further, the shock-absorbing part is provided in a region extending from a forefoot region overlapping a forefoot portion of the wearer of the shoe in the thickness direction of the sole to a midfoot region overlapping a midfoot portion of the wearer of the shoe in the thickness direction of the sole.

In this aspect, the impact applied to the forefoot portion or the midfoot portion is cushioned.

In this case, it is preferable that the low-elastic region be formed at a position overlapping a thenar of the wearer of the shoe in the thickness direction of the sole.

In this aspect, in particular, the impact applied to the thenar is effectively cushioned.

Further, a shoe according to one aspect of this disclosure includes the sole and the upper directly or indirectly connected to the sole and located above the sole.

In the shoe, the upper may include an insole connected to a surface of the sole. In this case, it is preferable that the support surface be bonded to the insole, and the shock-absorbing part be not bonded to the insole.

This suppresses a reduction in the shock-absorbing effect of the shock-absorbing part due to an adhesive entering between the columnar bodies adjacent to each other.

It should be understood that the embodiments disclosed herein are illustrative in all respects and not restrictive. The scope of the present invention is defined by the claims rather than the above description of the embodiments, and the present invention is intended to include the claims, equivalents of the claims, and all modifications within the scope.

REFERENCE SIGNS LIST

1: shoe, 10: sole, 20: upper, 100: outer sole, 200: midsole, 201: top midsole, 202: bottom midsole, 203: cushioning part, 210: shock-absorbing part, 210*a*: fore end part, 210*b*: rear end part, 210*c*: medial edge part, 210*c*1: fore edge part, 210*c*2: rear edge part, 210*d*: lateral edge part, 210H: high-elastic region, 210L: low-elastic region, 212: recessed surface, 212*a*: base surface, 212*b*: inclined surface, 214: columnar body, 214*a*: lateral columnar body, 214*b*: medial columnar body, 214*c*: central columnar body, 214H: columnar body, 214L: columnar body, 215: hollowed part, 216L: connecting part, 220: support part, 220*a*: support surface, 222: medial support part, R1: forefoot region, R2: rearfoot region, R3: midfoot region

The invention claimed is:

1. A sole constituting a part of a shoe, the sole comprising:

a shock-absorbing part that cushions an impact applied to a foot upon landing, the shock-absorbing part being longer in a longitudinal direction than in a width direction; and a support part that is higher in elastic modulus than the shock-absorbing part and supports the foot, wherein the support part includes a support surface provided around the shock-absorbing part, the shock-absorbing part includes:

a recessed surface located at a height position lower than the support surface; and a plurality of columnar bodies each having a shape extending from the recessed surface to a height position identical in height to the support surface, and the shock-absorbing part includes:

a high-elastic region that is located adjacent to the support surface; and a low-elastic region that is located adjacent to the high-elastic region and lower in elastic modulus than the high-elastic region, and the shock-absorbing part includes a fore end part that is located on a lateral side relative to a center line of the shoe in a width direction.

2. The sole according to claim 1, wherein each of the columnar bodies in the low-elastic region includes a hollowed part.

3. The sole according to claim 2, wherein the hollowed part is formed of a through hole extending through a corresponding one of the columnar bodies in a thickness direction of the sole.

4. The sole according to claim 1, wherein the low-elastic region is formed of a material lower in hardness than a material of the high-elastic region.

5. The sole according to claim 1, wherein the high-elastic region is shaped to surround an entire perimeter of the low-elastic region.

6. The sole according to claim 1, wherein the shock-absorbing part is provided in a rearfoot region that is adapted to overlap a rearfoot portion of a wearer of the shoe in a thickness direction of the sole.

7. The sole according to claim 6, wherein the low-elastic region is formed at a position that is adapted to overlap a calcaneus of the wearer of the shoe in the thickness direction of the sole.

8. The sole according to claim 1, wherein the shock-absorbing part is provided in a region extending from a forefoot region that is adapted to overlap a forefoot portion of a wearer of the shoe in a thickness direction of the sole to a midfoot region that is adapted to overlap a midfoot portion of the wearer of the shoe in the thickness direction of the sole.

9. The sole according to claim 8, wherein the low-elastic region is formed at a position that is adapted to overlap a thenar of the wearer of the shoe in the thickness direction of the sole.

10. A shoe comprising:

a sole according to claim 1; and an upper directly or indirectly connected to the sole and located above the sole.

11. The shoe according to claim 10, wherein the upper includes an insole connected to a surface of the sole, the support surface is bonded to the insole, and the shock-absorbing part is not bonded to the insole.

* * * * *